US010561195B2

(12) United States Patent
Jurgeto

(10) Patent No.: US 10,561,195 B2
(45) Date of Patent: Feb. 18, 2020

(54) PORTABLE SHOE COVER APPARATUS

(71) Applicant: Anthony L. Jurgeto, Lemont, IL (US)

(72) Inventor: Anthony L. Jurgeto, Lemont, IL (US)

( * ) Notice: Subject to any disclaimer, the term of this patent is extended or adjusted under 35 U.S.C. 154(b) by 300 days.

(21) Appl. No.: 14/317,589

(22) Filed: Jun. 27, 2014

(65) Prior Publication Data

US 2015/0374063 A1 Dec. 31, 2015

(51) Int. Cl.

| | |
|---|---|
| ***A43B 3/20*** | (2006.01) |
| ***A43B 1/00*** | (2006.01) |
| ***A43B 3/00*** | (2006.01) |
| ***A43B 7/12*** | (2006.01) |
| ***A43B 3/16*** | (2006.01) |
| ***A43B 7/08*** | (2006.01) |

(52) U.S. Cl.

CPC ..... *A43B 3/20* (2013.01); *A43B 1/0081* (2013.01); *A43B 3/0005* (2013.01); *A43B 3/0031* (2013.01); *A43B 3/16* (2013.01); *A43B 7/085* (2013.01); *A43B 7/12* (2013.01)

(58) Field of Classification Search

CPC ..... A43B 1/0081; A43B 5/18; A43B 7/085; A43B 7/12; A43B 7/005; A43B 3/20; A43B 3/005; A43B 3/0031

USPC ..... 36/72 R, 1.5, 2 R, 7.1 R, 7.2, 7.4, 7.7

See application file for complete search history.

(56) References Cited

U.S. PATENT DOCUMENTS 48,897 A * 7/1865 Blodgett ..... F16B 21/07 24/683
1,382,748 A * 6/1921 Slasor ..... A43B 3/20 36/72 R
1,574,773 A * 3/1926 Wharton ..... A41D 17/00 36/2 R
1,606,862 A * 11/1926 Zenishek ..... A41D 17/00 36/2 R
1,727,728 A * 9/1929 Otallah ..... A43B 3/16 36/72 R
1,970,600 A * 8/1934 Frost ..... A43D 11/00 36/72 C
2,087,110 A * 7/1937 Manolis ..... A41D 17/005 36/2 R
2,099,476 A * 11/1937 Glowka ..... A41D 17/00 36/2 R (Continued)

FOREIGN PATENT DOCUMENTS

CA 2307053 A1 * 5/1999 ..... A43B 3/16
EP 1588639 A1 * 10/2005 ..... A41D 17/005

(Continued)

*Primary Examiner* — Alissa J Tompkins
*Assistant Examiner* — Catherine M Ferreira
(74) *Attorney, Agent, or Firm* — Lesavich High-Tech Law Group, S.C.; Stephen Lesavich

(57) ABSTRACT

A portable shoe cover apparatus. The portable shoe cover apparatus includes a shoe cover portion and a shoe cover connection portion. The shoe cover portion is attachable and removable for covering a top portion of a shoe but not covering a bottom portion of a sole of the shoe. The shoe cover portion comprises a waterproof or water resistant portion. The shoe cover connection portion is connected to a top end of the shoe cover portion and is attachable and removable to a portion of a person wearing the shoe and comprises an insect repellant portion. The shoe cover apparatus is attachable and removable to the shoe via plural different types of attachment means.

20 Claims, 12 Drawing Sheets

(56) References Cited

U.S. PATENT DOCUMENTS 2,145,061 A * 1/1939 Stuart ..... A43B 3/20 36/2 R
2,229,563 A * 1/1941 Greenstein ..... A43B 3/16 36/2 R
2,235,490 A * 3/1941 Saksa ..... A43B 3/16 36/1
2,435,485 A * 2/1948 Wheaton ..... A43B 3/16 36/57
2,436,187 A * 2/1948 Bestland ..... A43B 3/20 36/72 R
2,438,308 A * 3/1948 Wheaton ..... A41D 17/00 36/2 R
2,599,116 A * 6/1952 Margulis ..... A43B 3/02 12/142 EV
2,625,752 A * 1/1953 Kemp ..... A43B 3/20 36/72 R
3,040,455 A * 6/1962 Criswell ..... A43C 13/14 36/72 R
3,250,025 A * 5/1966 Crescent ..... A43B 3/16 36/72 R
3,271,888 A * 9/1966 Graham ..... A43C 13/14 36/72 R
3,306,610 A * 2/1967 Biggs, Jr. ..... A43B 3/0031 36/132
3,319,362 A * 5/1967 Gomolka ..... A43B 3/20 36/7.4
3,430,491 A * 3/1969 Gignilliat ..... G01K 13/002 116/219
3,875,687 A * 4/1975 Henderson ..... A43B 3/16 36/7.1 R
3,949,493 A * 4/1976 Rhee ..... A43B 5/00 36/2 R
4,021,941 A * 5/1977 Caggiano ..... A01M 29/34 36/10
4,103,439 A * 8/1978 Abramson ..... A43B 1/10 36/7.3
4,168,584 A * 9/1979 Wren, Jr. ..... A43B 5/18 36/114
4,190,971 A * 3/1980 Wren, Jr. ..... A43B 5/18 36/106
4,489,509 A * 12/1984 Libit ..... A43B 1/0018 36/50.1
4,562,654 A * 1/1986 Hue ..... A43B 5/0411 36/117.2
4,598,485 A * 7/1986 Joe ..... A43B 3/163 36/7.2
4,604,816 A * 8/1986 Davison ..... A43B 5/18 36/1.5
4,616,429 A 10/1986 Alcala
4,665,633 A * 5/1987 Edgerton ..... A43B 3/16 36/2 R
4,713,895 A * 12/1987 Vallieres ..... A43B 3/24 36/1.5
4,825,563 A * 5/1989 Strongwater ..... A43B 3/16 36/7.1 R
5,005,216 A 4/1991 Blackburn
5,016,623 A * 5/1991 Krahenbuhl ..... A61F 13/066 128/882
5,144,759 A * 9/1992 Mascotte ..... A43B 3/16 36/7.1 R
5,165,182 A * 11/1992 Michael ..... A43B 3/16 36/1.5
5,172,493 A * 12/1992 Diaz ..... A41D 17/00 36/1.5
5,251,386 A * 10/1993 Diaz ..... A41D 17/00 36/1.5
5,272,822 A 12/1993 Diaz
5,337,491 A * 8/1994 Mascotte ..... A43B 3/16 36/7.1 R
5,469,637 A * 11/1995 Adam ..... A41D 17/00 36/1.5
5,544,430 A * 8/1996 Jacko ..... A43B 3/16 36/100
5,566,476 A * 10/1996 Bertrand ..... A43B 5/18 36/72 R
5,678,330 A * 10/1997 Van Dyke ..... A43B 5/00 36/114
5,737,858 A * 4/1998 Levy ..... A43B 5/02 36/128
5,778,564 A * 7/1998 Kettner ..... A43B 3/24 36/100
5,787,607 A 8/1998 Schurch
5,822,884 A * 10/1998 Roeder ..... A43B 3/163 36/59 C
5,829,170 A * 11/1998 Lutz, Jr. ..... A43B 5/1683 36/7.1 R
5,845,416 A * 12/1998 Hands ..... A43B 3/16 36/105
5,873,185 A * 2/1999 Harris ..... A43B 3/20 36/131
5,887,359 A * 3/1999 Falguere ..... A41D 17/00 36/1.5
5,970,633 A * 10/1999 Jones ..... A43B 1/0036 36/136
5,987,778 A * 11/1999 Stoner ..... A41D 17/00 36/1.5
D404,189 S 12/1999 Watson
5,996,258 A * 12/1999 Simmons ..... A43C 13/14 36/7.1 R
6,038,792 A * 3/2000 Hauter ..... A43B 5/02 36/133
D425,289 S 5/2000 Sheppard
6,178,555 B1 1/2001 Williams
6,301,803 B1 * 10/2001 Patterson ..... A41D 17/00 36/1.5
6,457,260 B1 * 10/2002 Roelofs ..... A41D 17/00 2/23
6,988,328 B2 1/2006 Rosen
7,127,836 B1 * 10/2006 Jamison ..... A43B 3/16 36/72 R
7,165,342 B2 1/2007 Sheen
7,523,567 B1 * 4/2009 McClelland ..... A43B 5/1666 36/115
7,730,636 B2 * 6/2010 Auger ..... A43B 5/02 36/100
7,908,771 B2 * 3/2011 Foxen ..... A43B 7/20 36/100
7,926,120 B2 4/2011 Birmingham
D636,977 S 5/2011 Yarn
7,937,852 B1 5/2011 Krehbiel
8,141,169 B2 3/2012 Saranga
8,171,653 B1 * 5/2012 Pennington ..... A41D 17/005 36/1.5
8,225,529 B2 7/2012 Simms
8,316,563 B2 11/2012 Wegner
D671,719 S 12/2012 LoConte
D672,537 S 12/2012 Birmingham
8,407,917 B2 4/2013 Barrick
D683,114 S 5/2013 Vardell
8,443,528 B2 5/2013 Kann
8,453,355 B2 6/2013 Kay
8,463,765 B2 6/2013 Lesavich
D686,806 S 7/2013 Belcher
8,474,153 B2 7/2013 Brie
8,671,588 B2 3/2014 Hampton
9,037,564 B2 5/2015 Lesavich et al.
9,137,250 B2 9/2015 Lesavich et al.
9,361,479 B2 6/2016 Lesavich et al.
9,569,771 B2 2/2017 Lesavich et al.
2002/0066208 A1 * 6/2002 Hall ..... A43B 3/0078 36/7.3
2003/0190442 A1 * 10/2003 Campbell ..... A43B 3/16 428/35.2
2004/0076219 A1 * 4/2004 Madison ..... A63B 71/085 374/159
2004/0163279 A1 * 8/2004 Gadson ..... A43B 3/16 36/7.1 R

(56) References Cited

U.S. PATENT DOCUMENTS

2004/0200097 A1* 10/2004 Boyd ..... A43B 3/0078 36/96
2005/0066547 A1* 3/2005 Al-Rasheed ..... A43B 7/00 36/95
2005/0076538 A1* 4/2005 Sapp ..... A43B 3/18 36/72 R
2005/0183285 A1* 8/2005 Cote ..... A43B 3/166 36/1.5
2005/0223595 A1* 10/2005 Wright ..... A43B 1/0027 36/7.1 R
2005/0246921 A1* 11/2005 Baek ..... A43B 3/163 36/7.1 R
2008/0047169 A1* 2/2008 Hoch ..... A43B 1/0081 36/2 R
2009/0019735 A1* 1/2009 Parisi ..... A43B 3/166 36/136
2009/0183394 A1* 7/2009 Mycoskie ..... A41D 17/04 36/2 R
2011/0208710 A1 8/2011 Lesavich
2011/0252581 A1* 10/2011 Teichert ..... A43B 3/16 12/146 R
2012/0018398 A1* 1/2012 Geijzendorffer ..... G01K 11/165 215/11.2
2012/0079748 A1* 4/2012 Block ..... A43B 3/166 36/72 R
2012/0198595 A1* 8/2012 Young ..... A41D 17/00 2/69
2012/0260536 A1* 10/2012 Espino Botello ..... A43B 3/16 36/72 R
2012/0278622 A1 11/2012 Lesavich et al.
2013/0305570 A1* 11/2013 Blake ..... A41D 17/02 36/2 R
2014/0189792 A1 7/2014 Lesavich et al.
2015/0143724 A1* 5/2015 Rivera ..... A43B 23/24 36/72 R
2015/0374063 A1* 12/2015 Jurgeto ..... A43B 3/20 36/72 R
2015/0379301 A1 12/2015 Lesavich et al.
2016/0321654 A1 11/2016 Lesavich et al.

FOREIGN PATENT DOCUMENTS

WO WO 9828999 A1 * 7/1998 ..... A43B 3/16
WO WO2008101306 A1 * 8/2008 ..... A41D 1/08
WO WO 2012019608 A1 * 2/2012 ..... A43B 3/00
WO WO 2012033503 A1 * 3/2012 ..... A43B 1/0027

* cited by examiner

PRIOR ART

PORTABLE SHOE COVER APPARATUS

FIELD OF THE INVENTION

This invention relates to shoe covers. More specifically, it relates to a portable shoe cover apparatus.

BACKGROUND OF THE INVENTION

There are many types of running shoes and many types of other athletic shoes that are used for athletic events such as soccer, baseball, golf, etc. There are also athletic shoes that are used for hiking, climbing etc. All such shoes may be used in inclement weather, such as rain, snow, severe cold, etc. Shoes used for hiking and climbing are typically used in areas with dangerous biting insects.

There are a number of problem with shoe covers. One problem is that many shoe covers cover both the top and sole portion of the shoe making the shoe hard to use for running, hiking, golf, football, baseball, or other athletic events. Another problem is that many shoe covers do not protect an ankle or leg of a wearer and protect only the shoe. Another problem is that many shoe covers do not attach to pre-existing features of the shoes they cover. Another problem is that many shoe covers do not provide any protection against biting insects such as ticks that can cause serious diseases such as Lyme disease. Another problem is that many shoe covers do not protect the ankle area allowing rain, sleet, snow, dirt, stones, debris or plant material to enter the shoe cover.

There have been some attempts for solving some of the problems associated with shoe cover. For example, U.S. Pat. No. 8,671,588 that issued to Hampton teaches "a shoe cover having a covering sized to receive a shoe and a sole coupled to the covering. In one example embodiment, the covering is made of an elastic material and the sole includes a serrated edge for expanding a perimeter portion of the sole."

U.S. Pat. No. 8,443,528 that issued to Kann teaches "A bottomless rainproof shoe cover assembly includes a shoe cover and a fixture. The shoe cover is formed into one body by injection molding. One side of the shoe cover is provided with a lateral opening. Fastening tapes are provided on both sides of the lateral opening. The lower periphery of the shoe cover is provided with protrusions. The top surface of the shoe cover is provided with protrusions to form a fixing trough. Both sides of the fixing trough are provided with a positioning hole. The fixture is positioned in the fixing trough for keeping the shoe cover in shape. The present invention provides a greater degree of coverage and convenience in use. Further, the manufacturing process, the amount of materials and the cost are reduced."

U.S. Pat. No. 8,407,917 that issued to Barrick teaches "An apparatus, system, and method are disclosed for a shoe cover. The shoe cover is useful for muffling sound of the wearer. The apparatus contains a padded sole, an encasing material, vertical straps, an attachment mechanism on the straps, and a replaceable cover. The replaceable cover can be substituted when the replaceable cover becomes worn or when a different type of cover is desirable."

U.S. Pat. No. 8,474,153 that issued to Brie teaches "he present invention provides a shoe cover to adaptively fit over a shoe. The show cover has a sole, which includes at least two rigid bands of rigid material, disposed on the bottom of the sole and arranged in spaced relation to each other on opposite sides of a longitudinal axis of the sole, thereby rigidifying the sole. The sole also has an elastic band of the flexible material, spanning longitudinally between the two rigid bands from the front to the rear of the sole, thereby enabling lateral flexibility to adapt to a shoe. The present invention also provides a rigid L-shaped element, each including a first portion on the ground side, a second portion on the side wall, and a fulcrum joining them, to clamp an inserted shoe. A double injection method for producing the above is also provided."

U.S. Pat. No. 8,453,355 that issued to Kay teaches "A cover for cleated shoes. The shoe cover has a ball area, a heel area, and a mid-foot area between the ball area and the heel area. At least the mid-foot area is formed of stretchable material and is thinner than the material forming the ball area and heel of the sole. An internal support member is located internally in the ball area and/or heel area of the sole. An upper portion extends upward from the sole portion and defines a toe cup and a heel cup, with the upper portion being formed of stretchable material in at least the mid-foot area, and which has an opening formed therein to allow shoe and/or foot access to the shoe cover."

U.S. Pat. No. 8,316,563 that issued to Wiegner teaches "Disclosed is a shoe and an interchangeable shoe cover system. The system includes a shoe having an upper with a bottom surface, a sole having an upper surface. One or more slots are defined between the bottom surface of the upper and the upper surface of the sole. The system also includes a shoe cover having at least one rigidly flexible frame member configured to engage with the one or more slots. The shoe cover also includes a cover material portion securely attached to the frame member and that is configured to be extendible into the upper portion of the shoe to secure the cover, as well as pull it taught or tension it over the outer surface of the shoe."

U.S. Pat. No. 8,225,529 that issued to Simms teaches "A lightweight yet durable, self-adhering, protective overshoe with integrated cleaning bosses providing a more efficient and complete method for athletic cleat or boot cleaning, maintenance, handling and storage."

U.S. Pat. No. 8,141,169 that issued to Saranga teaches "A lower leg protection device includes a knee protection section. A flanged shin protection section is flexibly connected to the knee protection section. At least one replaceable outer cushion is selectively secured to the knee protection section via a first strap, and at least one replaceable outer cushion is selectively secured to the shin protection section via a second strap."

U.S. Pat. No. 7,937,852 that issued to Krehbiel teaches "A flexible, elastic gaiter device designed to doubly encircle an upper rim of a wearer's footwear as well as the wearer's ankle to block ingress of debris into the footwear upper rim while bracing wearer's ankle protecting it against external and internal injury. The device is an elongated generally rectangular article. It comprises a closed loop nylon plush fabric outer layer to which is foamed an inner layer of synthetic rubber based on polychloroprene. At one end of the article's rubbery layer a fastener strip of hook elements is attached. The gaiter device is applied with its rubbery layer bridging the footwear upper rim, and firmly stretched to a double wrap, then secured by fastening the strip of hook elements with the plush outer layer. Lower edge corners of the article are diagonally cropped so that, when stretched, the lower edge will not have unsightly exposed portions."

U.S. Pat. No. 7,926,120 that issued to Birmingham teaches "The Impervagown and Impervashoe are made of material/fabric that is impervious to all fluids and liquids. The Impervawear prevents and protects against cross-contamination of harmful or negative fluids. This protection allows employees to work comfortably and effectively in dry clothing for the duration of their work shift. By doing so, employees will be more confident in their approach to patient care, specifically giving "showers". Most importantly, the purpose of Impervawear is to allow for an increase in patient "showers" improving hygiene, decreasing the probability of bedsores and allowing patients to experience the peace of mind and confidence they deserve."

U.S. Pat. No. 7,165,342 that issued to Sheen teaches "The shoe cover is formed from two sheets of tough flexible material shaped to cooperatively shield a shoe. The first sheet forms a first shield member for protecting the metatarsal area of a foot or shoe. The second sheet forms a second shield member, adjustably attachable to the first shield member and shaped to generally cover the toe area of the shoes. Eyelets are arranged on a fold area of the first shield member between fastener patches so that the upper portion of the sheet can be folded upon itself to cover shoelaces tied through the eyelets and the tongues of the shoes. A wide patch of hook and loop fastener material is secured onto the back face of the first shield member to cooperate with a narrower strip of fastener material secured to the second shield member to adjustably cover the toes of shoes in a range of sizes."

U.S. Pat. No. 6,988,328 that issued to Rosen teaches "shoe cover has an upper and a sole connected to the upper. The upper includes at least one, self-supporting and resilient shoe admission portion connected to the sole. The shoe admission portion has an inwardly inclined lead-in surface extending toward the sole, and an overhang surface extending from the lead-in surface toward the sole portion. The overhang surface is adapted to form an undercut area so that a shoe to be held to the shoe cover first engages and slides along the inclined lead-in surface to resiliently expand the admission portion outwardly without being crushed, and then slides into engagement with the overhang surface to enter the undercut area. A length adjusting mechanism may be provided for adjusting the length of the sole."

U.S. Pat. No. 6,178,555 that issued to Williams teaches "A lower leg and foot cover for covering the knee and lower leg regions of a user's pants and the front of the user's shoes from soiling and soaking. The lower leg and foot cover includes a knee cover which is coupled to an upper end of a flexible lower leg cover. A flexible shoe cover is coupled to a lower end of the lower leg cover. Flexible straps are provided for securing the knee cover and the lower leg cover to the wearer's leg."

U.S. Pat. No. 5,996,258 that issued to "A flexible shoe protector for shielding shoes from scratches and abrasions having an upper member that extends over a front top portion of a shoe, a lower member extending below a front sole portion of the shoe and extending rearwardly toward the heel of the shoe, and an intermediate flexible portion connected between the upper member and the lower member. The intermediate flexible portion is capable of stretching to accommodate a variety of sizes and shapes of different shoes. A flexible strap member is attached to a rearward portion of the intermediate flexible portion so that the strap member is used to stretch about a rearward portion of the shoe above the heel, for securement of the shoe cover to the shoe. The flexible strap and the intermediate portion are made from a material having elastic qualities, such as Spandex. A rubber portion is attached to the bottom of the lower member to provide traction when a wearer is wearing the shoe protector. Optional features include the addition of reflecting material or glow-in-the-dark material to the shoe protector, for increased visibility in darkness."

U.S. Pat. No. 5,787,607 that issued to Schurch teaches "A shoe cover for being worn over the shoes consists of a cover foil adapted to protect the shoe and at least a part of the calf of a person and a reinforcing foil adapted to reinforce at least the sole portion of the cover foil. The cover foil is made of a first soft or plasticized polymer, and the reinforcing foil is made of a second soft or plasticized polymer. Besides the sole portion, the cover foil consists of a shaft portion. The sole portion of the cover foil is reinforced by the reinforcing foil by welding them together by means of a plurality of punctual welding points. Those welding points form a plurality of punctual recesses in the reinforcing foil, which recesses cause a sucker effect, such that a high adhesion between the shoe cover and the ground results. At the shaft portion, the cover foil is provided with a strap or a tape which allows to tighten the shoe cover at the foot or calf of a person. Such a shoe cover is lightweight, may be used several times and, due to the fact that it may be folded, needs not much space for storing."

U.S. Pat. No. 5,272,822 that issued to Diaz teaches "A flexible protective cover for boots and shoes to protect the wearer from injury. The cover is a unitary member covering the toe and forward portion of the shoe or boot, extending to the ankle on both sides of the shoe or boot and backwardly to cover the back of the shoe or boot. The protective cover is partially removable from the shoe or boot having a back portion which is removably secured about the back of the shoe or boot. The toe portion of the protective cover is permanently secured to the toe portion of the shoe or boot. Preferably, the toe portion of the protective cover is sewn to the sole plane of the shoe or boot. In a preferred embodiment, a tab is formed on one side of the protective cover. The tab secures the side portions of the protective cover to the back of the shoe or boot. The protective cover is preferably a multi-layer member having a lining means formed of a high modulus fiber."

U.S. Pat. No. 5,251,386 that issued to Diaz teaches "A flexible protective cover for boots, shoes and the like to protect the wearer from injury from a chainsaw. The cover has a lining of layers of high modulus fiber fabric between an inner layer and a outer layer of durable fabric. The lining is secured between the inner layer and the outer layer by a quilt-like stitching. The protective cover is folded to conform to the instep of the shoe and extend to the ankle. A strap and fasteners are attached to the cover to permit the cover to be secured over the shoe in a rapid and easy manner. In a preferred embodiment, a tab is formed on one side of the cover and a bail is attached to the other side of the cover. The tab is pulled through the bail and returned approximately 180.degree. to the one side of the cover. The tab is held by quick-release fasteners to the one side of the cover thereby firmly securing the cover longitudinally to the boot or shoe. Transverse fastening means are provided between the lower edge of the side portions of the cover and the sole plane of the shoe. A cord formed of lining fibers is attached to the lower edge of the side portions of the cover to provide additional protection to the edge of the cover."

U.S. Pat. No. 5,165,182 that issued to Michael teaches "Disclosed herein is a shoe cover which has an open-ended bottom such that when the shoe cover is placed over a shoe, the uppers portion of the shoe is covered and protected while the sole of the shoe is at least partially exposed so that the traction of the shoe itself may be utilized by the wearer. In more refined embodiments, the shoe cover is provided with a number of methods for providing additional securement of the shoe cover to the shoe of a wearer."

U.S. Pat. No. 5,005,216 that issued to Blackburn teaches "A protective garment is fed pressurized air through a hood piece connected to a pressurized air source and expels the air through air breather panels formed in the lower leg portions of the garment to prevent ballooning of the garment."

U.S. Pat. No. 4,665,633 that issued to Edgerton teaches "A sole-less shoe top cover is formed of a single thickness of flexible fabric for protecting a shoe upper from paint or plaster drippings. Three vertically spaced lines of stitched elastic cords are stitched in-and-out around the lower portion of the cover."

U.S. Pat. No. 4,616,429 that issued to Alcala teaches "There as disclosed a disposable shoe cover and method of continuously manufacturing the shoe covers from two source rolls of flat, flexible material, producing no scrap."

U.S. Pat. No. 4,103,439 that issued to Abramson teaches "A shoe cover is described for use in dust-free and decontamination rooms, as protective rainwear, or the like, characterized in that it is made as a one-piece unit of thin, pliable, elastic material including a sole portion and a top portion formed in the shape of a foot to tightly enclose the complete wearer's shoe and to extend slightly above and to grip its upper edge, the outer face of the shoe cover being formed with a network of ribs which increase its tensile and shear strength, isolate tears, and reduce slip. Also described is a method of making the shoe cover wherein a form is dipped obliquely into a latex bath after having been coated with a coagulant, is dried, and is then stripped of the produced shoe cover."

U.S. Design Pat. No. D686,806 that issued to Belcher teaches "The ornamental design for a shoe cover, as shown and described."

U.S. Design Pat. No. D683,114 that issued to Verdell teaches "The ornamental design for a shoe cover, as shown and described."

U.S. Design Pat. No. D672,537 that issued to Birmingham teaches "The ornamental design for a shoe cover, as shown and described."

U.S. Design Pat. No. D671,719 that issued to LaConte "The ornamental design for a shoe cover, as shown and described."

U.S. Design Pat. No. D636,977 that issued to Yarn teaches "The ornamental design for a shoe cover, as shown and described."

U.S. Design Pat. No. D636,977 that issued to Sheppard teaches "The ornamental design for a shoe cover, as shown and described."

U.S. Design Pat. No. D404,189 that issued to Watson "The ornamental design for a shoe cover, as shown and described."

However, none of these solutions solve all the problems associated with shoe cover. Thus, it is desirable to provide a new type of shoe cover.

SUMMARY OF THE INVENTION

In accordance with preferred embodiments of the present invention, some of the problems associated with shoe protectors are overcome. A portable shoe cover apparatus is presented.

A portable shoe cover apparatus. The portable shoe cover apparatus includes a shoe cover portion and a shoe cover connection portion. The shoe cover portion is attachable and removable for covering a top portion of a shoe but not covering a bottom portion of a sole of the shoe. The shoe cover portion comprises a waterproof or water resistant portion. The shoe cover connection portion is connected to a top end of the shoe cover portion and is attachable and removable to a portion of a person wearing the shoe and comprises an insect repellant portion. The shoe cover apparatus is attachable and removable to the shoe via plural different types of attachment means.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTION

Figure 1:
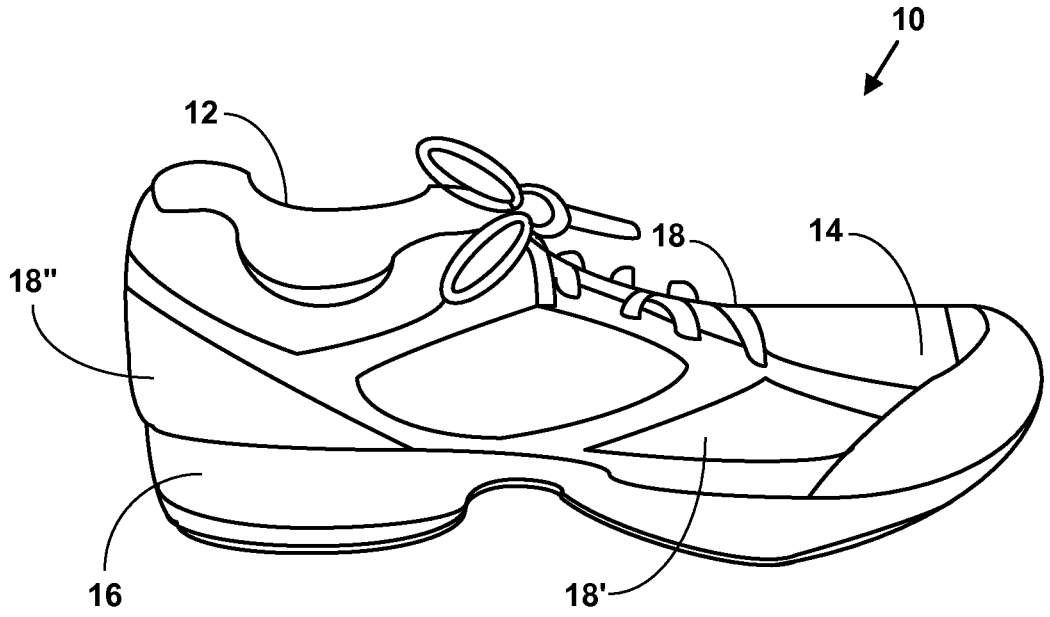
FIG. 1 is a block diagram of an exemplary athletic shoe.

FIG. 1 is a block diagram 10 of an exemplary athletic shoe 12. The shoe 12 includes a top portion 14 and a sole portion 16.

Figure 2:
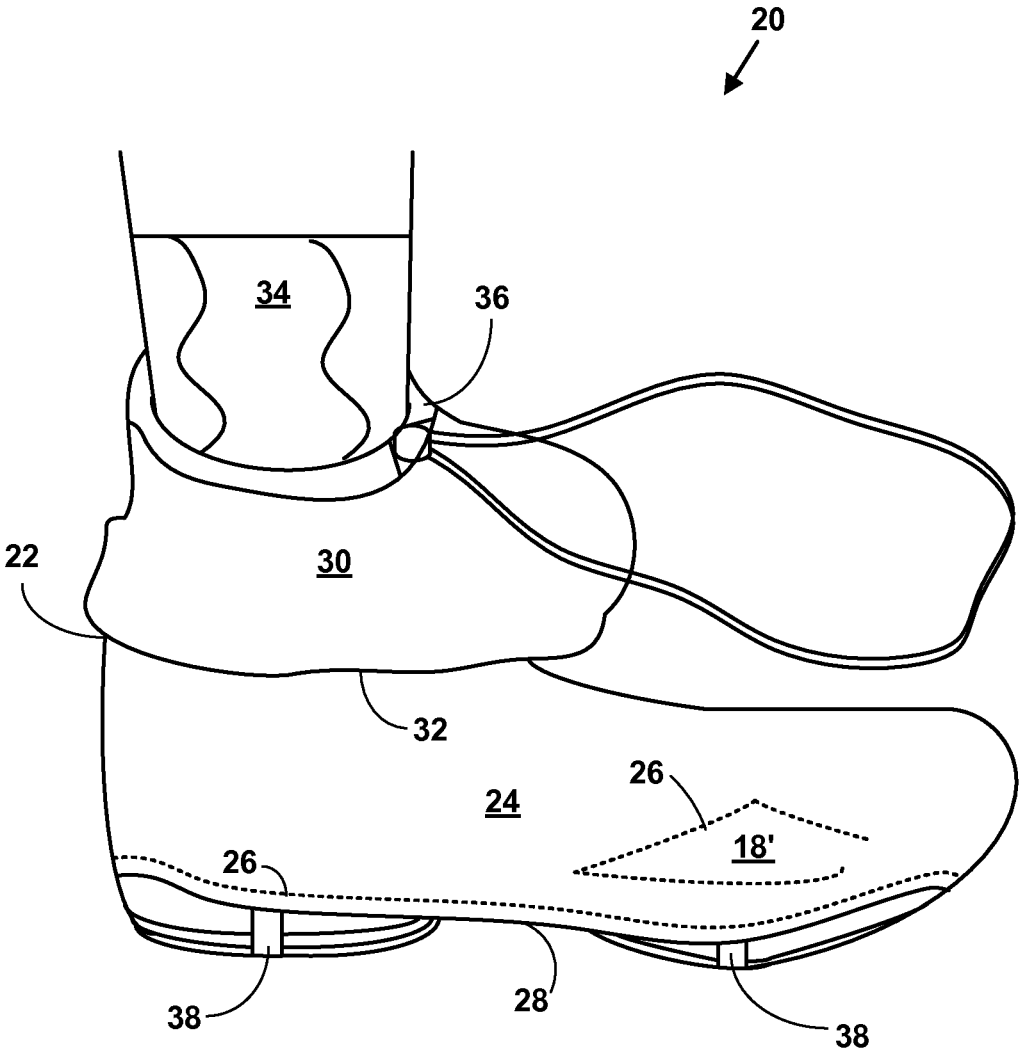
FIG. 2 is a block diagram of a portable shoe cover apparatus for the exemplary athletic shoe of FIG. 1.

FIG. 2 is a block diagram 20 of a portable shoe cover apparatus 22 for the exemplary athletic shoe 12 of FIG. 1.

Figure 3:
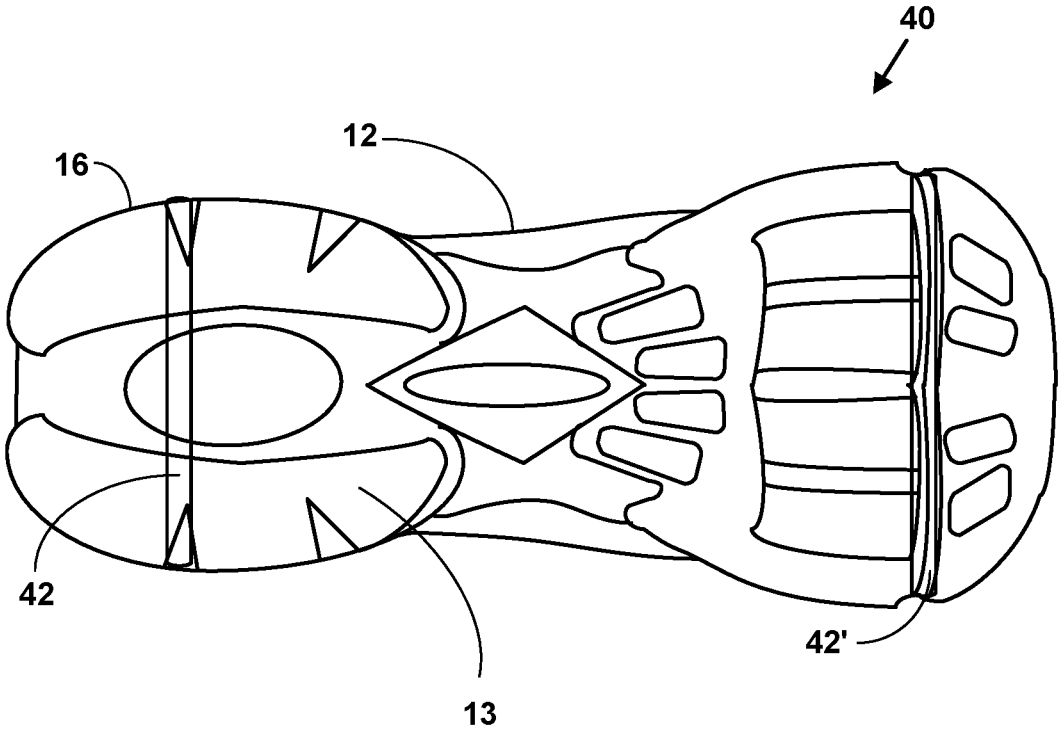
FIG. 3 is a block diagram illustrating an exemplary sole portion of the exemplary athletic shoe of FIGS. 1 and 2.

FIG. 3 is a block diagram 40 illustrating an exemplary sole portion 16 of the exemplary athletic shoe 12 of FIGS. 1 and 2.

The shoe cover apparatus 22 includes a shoe cover portion 24 attachable and removable for covering a top portion 14 of a shoe 12 but not covering a bottom portion 13 of sole 16 of the shoe 12. The shoe cover portion 24 comprises a waterproof and/or a water resistant portion. Plural first attachment portions 26 at a bottom end 28 of the shoe cover portion 24 attach the shoe cover portion 24 to the top portion 14 of the shoe 12. Selected ones of the plural first attachment portions 26' are specifically sized and shaped to attach onto pre-existing features 18, 18' (e.g., laces, ridges, grooves, etc.) of the top portion 14 of the shoe 12. A shoe cover connection portion 30 at a top end 32 of the shoe cover portion 24 is attachable and removable to a portion (e.g., an ankle, leg, etc.) of a person 34 wearing the shoe 12. The shoe cover connection portion 30 includes a shoe cover attachment portion 36. The shoe cover connection portion 30 comprises an insect repellant portion. Plural second attachment portions 38 attached to the bottom end 28 of the shoe cover portion 24 include apparatus for attaching the shoe cover portion 12 to the sole 16 of the shoe 12. Selected ones of the plural second attachments portions 38 are specifically sized and shaped to attach onto and through pre-existing features 42, 42' (FIG. 3) of the sole portion 16 of the shoe 12. However, present invention is not limited to the components described and more, fewer and other component of the shoe cover can be used to practice the invention.

The shoe cover portion 24 includes a fabric comprising: synthetic fiber fabrics, natural fiber fabrics, composite materials fabrics, hard plastics, soft plastics and combinations thereof. However, the present invention is not limited to these shoe covering portions 24 and more, fewer and/or other shoe cover portions can be used to practice the invention.

In one embodiment, the shoe cover portion 24 comprises, various synthetic fiber fabrics (e.g., NYLON, etc.), natural fiber fabrics (e.g., animal, cotton, wool, silk, etc.), composite materials, hard and soft plastics, and/or propylene based materials, etc. However, the present invention is not limited to these shoe covering portions 24 and more fewer and/or other shoe cover portions can be used to practice the invention.

Natural fibers are a class of hair-like materials that are continuous filaments or are in discrete elongated pieces, similar to pieces of thread. They can be spun into filaments, thread, or rope. They can be used as a component of composite materials. They can also be matted into sheets to make products. Natural fiber which comprise animal and plant fibers. The most used plant fibers are paper, cotton, flax and hemp, although sisal, jute, kenaf, bamboo and coconut are also widely used. Animal fibers generally comprise proteins such as collagen, keratin and fibroin; examples include silk, sinew, wool, catgut, angora, mohair and alpaca, etc.

Some examples of synthetic fabrics are POLYESTER, ACRYLIC, NYLON, RAYON, ACETATE, SPANDEX, LASTEX and KEVLAR. Synthetic fibers are made by the joining of monomers into polymers, by the process of polymerization. A synthetic fiber, when magnified, looks like plastic spun together. The fabric is made from chemically produced fibers. The chemicals used to make the fibers are sodium hydroxide and carbon disulphide which are derived from coal, oil, or natural gas. The chemicals are in liquid form and are forced through tiny holes called spinnerets. As the liquid comes out of the spinnerets and into the air, it cools and forms into tiny threads. Dyes are added to these threads before they are woven together to make the fabric.

In one embodiment, the shoe cover portion 24 is created from a rigid plastic including Polyetherimide, Polyimide other thermosetting polyimides, other plastics and/or composite materials. The rigid plastics are poured, injection molded, pultruded, extruded, etc. However, the present invention is not limited to these materials and other materials can be used to practice the invention.

"Polyetherimide" (PEI) is an amorphous, amber-to-transparent thermoplastic with characteristics similar to the related plastic PEEK. Polyether ether ketone (PEEK) is a colorless organic polymer thermoplastic Relative to PEEK, PEI is cheaper, but less temperature-resistant and lower in impact strength.

For example, commercially, ULTEM is a family of PEI products manufactured by SABIC. ULTEM resins are used in medical and chemical instrumentation due to their heat resistance, solvent resistance and flame resistance.

"Polyimide" (PI) is a polymer of imide monomers. Such imide monomers include pyromellitic dianhydride and 4,4'-oxydianiline and others. Polyimide materials are lightweight, flexible, resistant to heat and chemicals. Polyimide parts are not affected by commonly used solvents and oils, including hydrocarbons, esters, ethers, alcohols and freons. They also resist weak acids.

"Thermosetting polyimides" are known for thermal stability, good chemical resistance, excellent mechanical properties. Normal operating temperatures for such polymides range from cryogenic with temperatures below about −238° F. (−150° C.) to those exceeding about 500° F. (260° C.).

In one embodiment, the shoe cover portion 24 is created from composite material fabric. "Composite materials" are engineered or naturally occurring materials made from two or more constituent materials with significantly different physical or chemical properties which remain separate and distinct at the macroscopic or microscopic scale within the finished structure. Common polymer-based composite materials, include at least two parts, a substrate (e.g., fibers, etc.) and a resin. However, the present invention is not limited to these plastic materials and other materials can be used to practice the invention.

The composite materials include "Fiber-reinforced polymers" (FRP) including thermoplastic composites, short fiber thermoplastics, long fiber thermoplastics or long fiber-reinforced thermoplastics. There are numerous thermoset composites, but advanced systems usually incorporate aramid fiber and carbon fiber in an epoxy resin matrix. The composite materials also include carbon/carbon composite materials with carbon fibers and a silicon carbide matrix. However, the present invention is not limited to these composite materials and other materials can be used to practice the invention.

In one embodiment the shoe cover portion 24 is constructed from flexible plastics including, but not limited to, PolyVinyl Chloride (PVC) polyethylene, polypropylene, very low-density polyethylene (VLDPE), linear low-density polyethylene (LLDPE) Flexible polypropylene (FPP), Ethylene interpolymer alloy (EIA), EPDM (ethylene propylene diene monomer), composite materials and/or other flexible materials. However, the present invention is not limited to these materials and other materials can be used to practice the invention.

Polyvinyl chloride (PVC) is durable, cheap, and easily worked into membranes. Polyvinyl chloride is produced by polymerization of a monomer, vinyl chloride (VCM). PVC's are relatively low cost, biological and chemical resistance and very workable into membranes.

Very low-density polyethylene (VLDPE) and linear low-density polyethylene (LLDPE) overcome the shortcomings of other polyethylenes (e.g., high density polyethylene (HDPE), etc. in terms of flexibility. These are less crystalline forms of polyethylene which result in increased flexibility and a membrane less conducive to brittle stress cracking.

Flexible polypropylene (FPP) is produced in both unreinforced (PPU) and reinforced (PPR) form to provide a choice in terms of tensile behavior.

Ethylene interpolymer alloy (EIA) is an alloy of PVC resin with a special ethylene interpolymer that results in a flexible plastic-free material. EIA geomembranes maintain the advantages of PVC but have a high degree of durability and chemical resistance.

EPDM (ethylene propylene diene monomer) was developed from butyl rubber and exhibits excellent elongation characteristics.

However, the present invention is not limited to these materials and other materials can be used to practice the invention.

In one embodiment, the shoe cover portion 24 includes Polyurethane coated CORDURA NYLON.

CORDURA is the brand name for a collection of fabrics used in a wide array of products including luggage, backpacks, pants, military wear and performance apparel. CORDURA fabrics are known for their durability and resistance to abrasions, tears and scuffs. CORDURA fabrics are made using yarns or fibers. Fabrics can be made using 100% synthetic fiber or in blends with cotton or other natural fibers.

NYLON is a generic designation for a family of synthetic polymers known generically as aliphatic polyamides. Nylon is one of the most commonly used polymers. Key representatives are nylon-6,6 nylon-6; nylon-6,9; nylon-6,10; nylon-6,12; nylon-11; nylon-12 and nylon-4,6.

However, the present invention is not limited to these materials and other materials can be used to practice the invention.

In one embodiment, the shoe cover portion 24 includes waterproof and/or water resistance breathable fabrics and/or fabrics coated with a waterproof and/or resistant proof coating. In such embodiments, the waterproof and/or water resistant fabrics are coated with a waterproofing and/or water resistant material after selecting of a desired fabric and/or include waterproof and/or moisture proof fabrics created during a manufacturing process.

Waterproof fabrics are fabrics that are inherently, or have been treated to become, resistant to penetration by water and wetting. The term "waterproof" refers to conformance to a governing specification and specific conditions of a laboratory test method. They are natural or synthetic fabrics that are laminated to or coated with a waterproofing material such as rubber, polyvinyl chloride (PVC), polyurethane (PIT), silicone elastomer, fluoropolymers, wax, etc. during a manufacturing process. However, the present invention is not limited to such embodiments and other waterproof fabrics and/or coatings can be used to practice the invention.

In contrast, water resistant or water repellant fabrics are coated with a compound (e.g., Durable Water Repellant (DWR), etc.) that is resistant but not impervious to penetration by water. Water-resistant fabrics will often bead up water, forming drops on the surface. Water-resistant fabrics will provide protection from limited precipitation, but may not stand up to complete submersion in a water. Though water can saturate the fabric with harsh exposure, a water-resistant treatment will prevent moisture from seeping through the fabric.

DWR is a coating added to fabrics at the factory to make them water-resistant (or hydrophobic). Most factory-applied treatments are fluoropolymer based. Durable water repellents are commonly used in conjunction with waterproof breathable fabrics such as GORE-TEX to prevent the outer layer of fabric from becoming saturated with water. This saturation, called "wetting out," can reduce the fabric's breathability (moisture transport through the breathable membrane) and let water through. As the DWR wears off over time, re-treatment is recommended when necessary. Many spray-on and wash-in products for treatment of non-waterproof garments and re-treatment of proofed garments losing their water-repellency are available from sources of sporting apparel. Sprays are made by GRANGERS, NIKWAX, MCNETT, TREK7, and others. Older methods for factory application of DWR treatments involve applying a solution of a chemical onto the surface of the fabric by spraying or dipping. More recently the chemistry is applied in the vapor phase using Chemical Vapor Deposition (CVD) machinery.

Waterproof and/or water resistant breathable fabrics resist liquid water passing through, but allow water vapor to pass through. Their ability to block out rain and snow while allowing vapor from sweat to evaporate leads to their use in rainwear, waterproof outdoor sports clothing and other applications. In another embodiment, the waterproof and/or water resistant proof fabrics include non-breathable waterproof and/or water resistant fabrics. However, the present invention is not limited to such embodiments and other breathable and/or non-breathable waterproof/water resistant fabrics and/or coatings can be used to practice the invention.

In one embodiment, the shoe cover portion 24 further includes an insect repellant fabric and/or insect repellant coating as is described for the shoe cover connection portion 30. In another embodiment, the shoe cover portion 24 includes only the insect repellant fabric and does not include the waterproof and/or moisture proof breathable fabrics In another embodiment, selected portions of the shoe cover portion 24 are coated with and/or include waterproof and/or moisture proof fabric and selected other portions include insect proof fabric and/or coated with an insect repellent. However, the present invention is not limited to these embodiments and various combinations of coated waterproof, coated insect proof and/or insect repellent fabrics and/or water resistant and or waterproof fabrics can be used to practice the invention.

The plural first attachment portions 26 at the bottom end 28 of the shoe cover portion 24 attach the shoe cover portion 24 to the top portion 14 of the shoe 12. Selected ones of the plural first attachment portions 26 are specifically sized and shaped to attach onto pre-existing features 18, 18' 18" (e.g., laces, ridges, grooves, etc.) of the top portion 16 of the shoe 12. The pre-existing features 18, 18' 18" are exemplary only and the present invention is not limited to a size, shape, etc. of the illustrated pre-existing features. Such pre-existing features vary depending on the type of shoe 12 used.

In one embodiment, the plural first attachment portions 26, 26' include a zipper fastener, an elastic fastener, a hook and loop fastener, a snap fastener, a button fastener, a pin fastener, a magnetic fastener, a strap fastener and/or combinations thereof.

However, the present invention is not limited to these plural first attachment portions 26, 26' and other attachment portions can be used to practice the invention.

Figure 4:
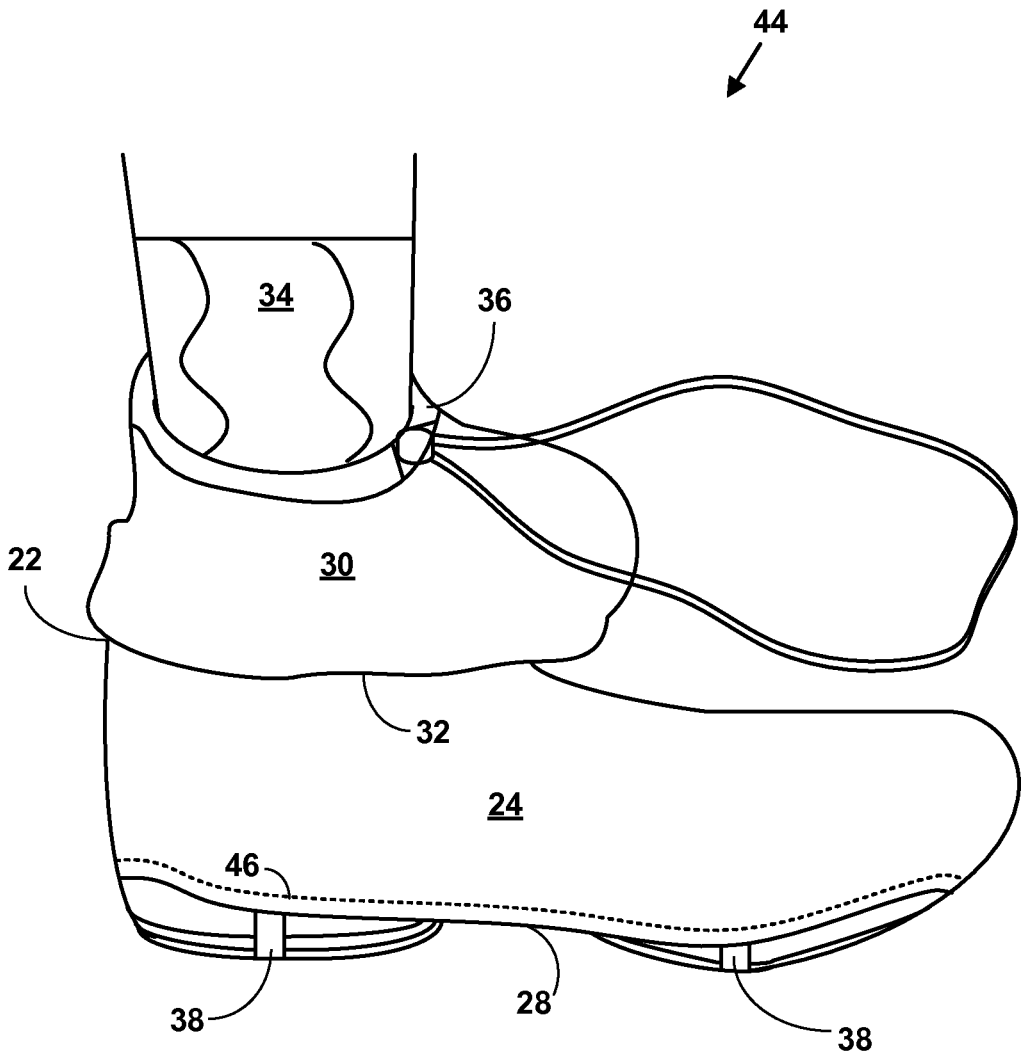
FIG. 4 is a block diagram illustrating an exemplary elastic fastener on the exemplary shoe cover apparatus of FIG. 2.

FIG. 4 is a block diagram 44 illustrating an exemplary elastic fastener 46.

The elastic fastener 46 includes a piece of flexible elastic integral to the bottom end 28 of the shoe cover portion 24. When a force is applied to the elastic fastener 46, the elastic expands and when the force is removed, the elastic contracts engaging the shoe 12.

Figure 5:
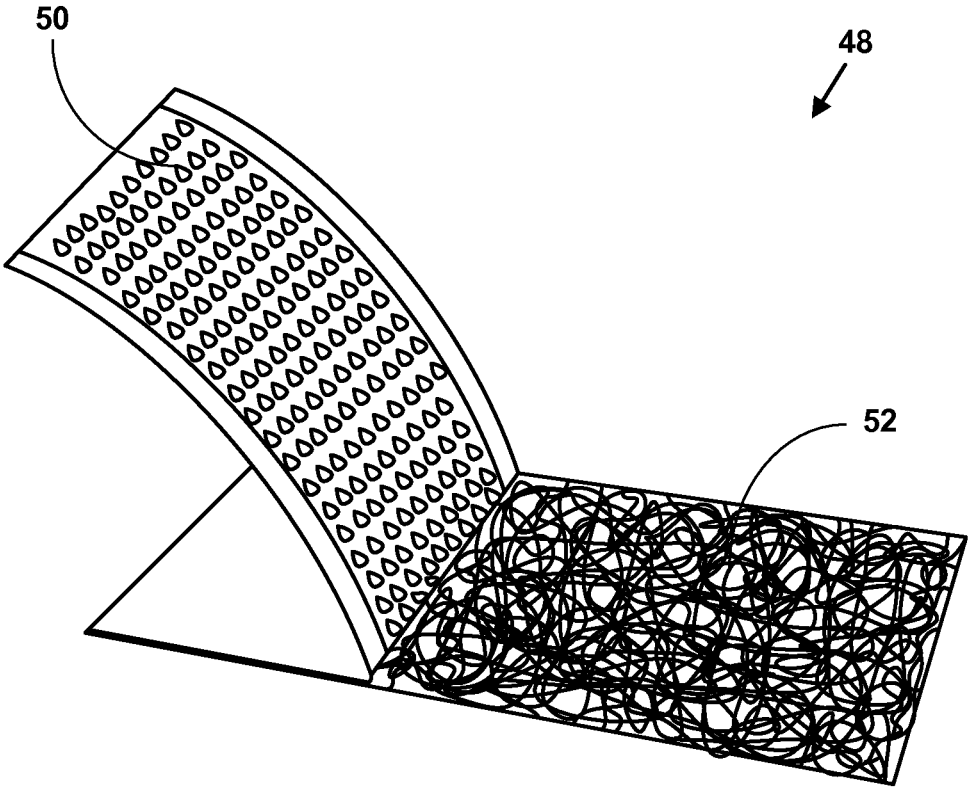
FIG. 5 is a block diagram a illustrating a hook and loop fastener.

FIG. 5 is a block diagram 48 illustrating a hook and loop fastener 50, 52.

Figure 6:
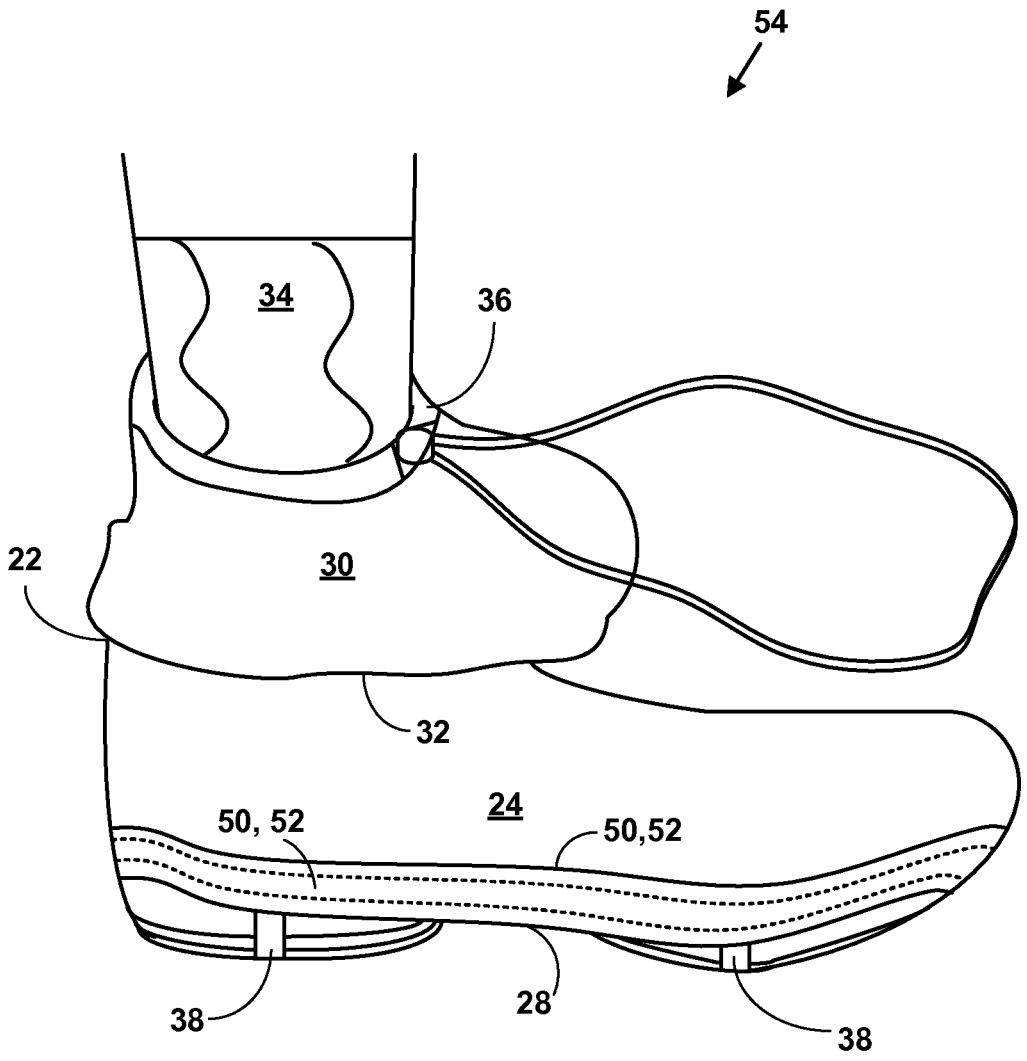
FIG. 6 is a block diagram illustrating an exemplary hook and loop fastener on the exemplary shoe cover apparatus of FIG. 2 connect to a top portion of the shoe.

FIG. 6 is a block diagram 50 illustrating an exemplary hook and loop fastener 46, 48 on the exemplary shoe cover apparatus of FIG. 2 connect to a top portion 14 of the shoe 12.

Hook and loop fasteners 50, 52 comprise two components: two lineal fabric strips (or, alternatively, round "dots" or squares or other shapes, etc.) which are attached (e.g., sewn, adhered, etc.) to the opposing surfaces to be fastened. The first component features tiny hooks 50 and the second features even smaller and "hairier" loops 52. When the two components are pressed together, the hooks 50 catch in the loops 52 and the two pieces fasten or bind temporarily during the time that they are pressed together.

VELCRO and DURAGRIP are examples of commercially available hook and loop fasteners. However, the present invention is not limited to such hook and loop fasteners and other hook and loop fasteners can be used to practice the invention.

In another embodiment, the hook and loop faster 46, 48 includes a loop portion 48 that is attached to the shoe cover portion 24 and a hook portion 46 attached to the sole portion 16 of the shoe 12 and vice versa as is illustrated in FIG. 6. In another embodiment, the hook and loop faster 46, 48 includes a hook portion 46 that is attached to the shoe cover portion 24 and a loop portion 48 attached to the sole portion 16 of the shoe 12 and vice versa.

In one embodiment, the hook and loop faster 50, 52 includes a loop portion 52 that is attached to the shoe cover portion 24 and a hook portion 50 attached to the top portion 14 of the shoe 12 and vice versa. In another embodiment, the hook and loop faster 50, 52 includes a hook portion 50 that is attached to the shoe cover portion 24 and a loop portion 52 attached to the top portion 14 of the shoe 12 and vice versa.

In another embodiment, one individual portion of the hook and loop fastener 50, 52 is attached to the shoe cover portion 24 during manufacture of the shoe cover portion 24 and the other is manually attached to the shoe 12. In another embodiment, one individual portion of the hook and loop fastener 50, 52 is attached to the shoe 12 during manufacture of the shoe 12 and the other is manually attached to the shoe cover portion 24. In another embodiment, one individual portion of the hook and loop fastener 50, 52 is attached to the shoe cover portion 24 during manufacture of the shoe cover portion 24 and the other is attached to the shoe 12 during manufacture. However, the present invention is not limited to these hoop and loop attachments and other attachments can be used to practice the invention.

Figure 7:
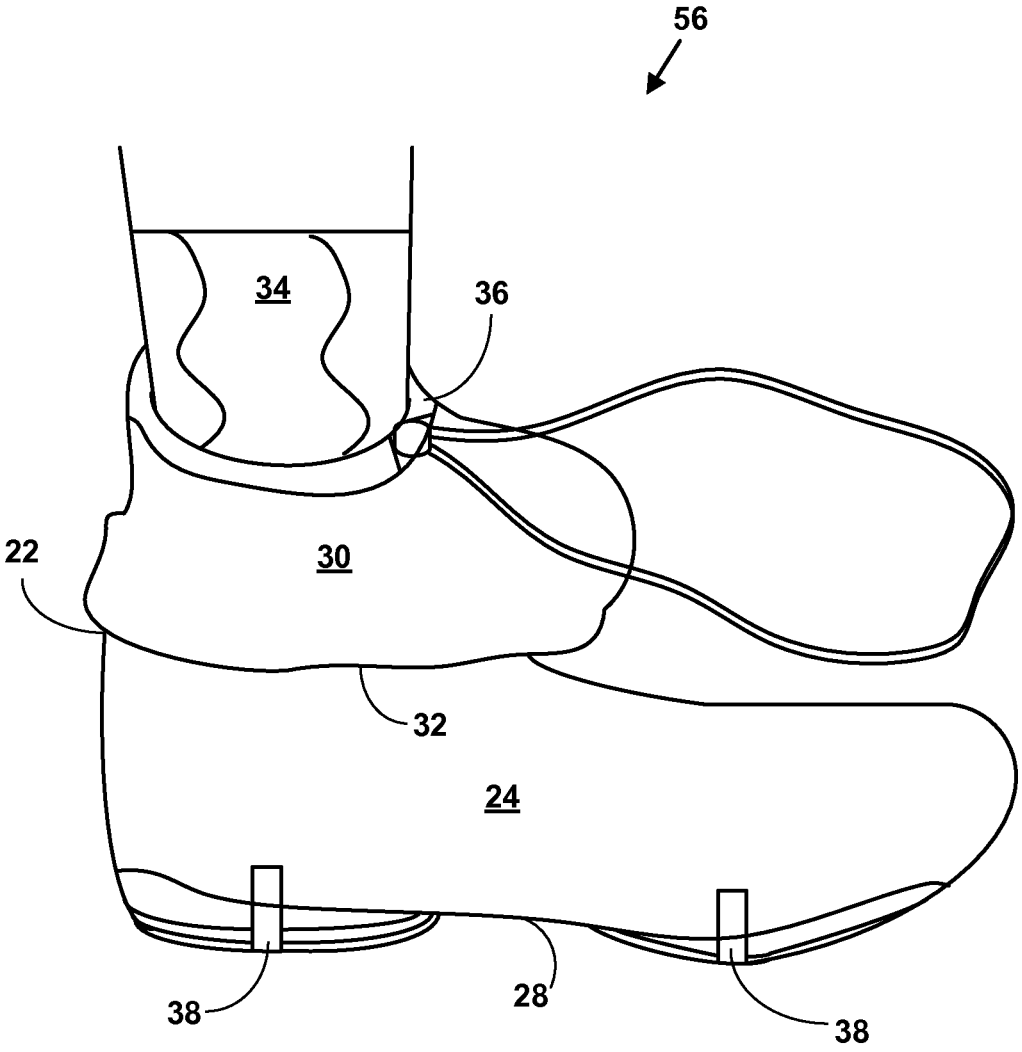
FIG. 7 is a block diagram illustrating fasteners on the exemplary shoe cover apparatus of FIG. 2.

FIG. 7 is a block diagram 56 illustrating exemplary plural second attachment components 38 on the shoe cover portion 24.

Figure 8:
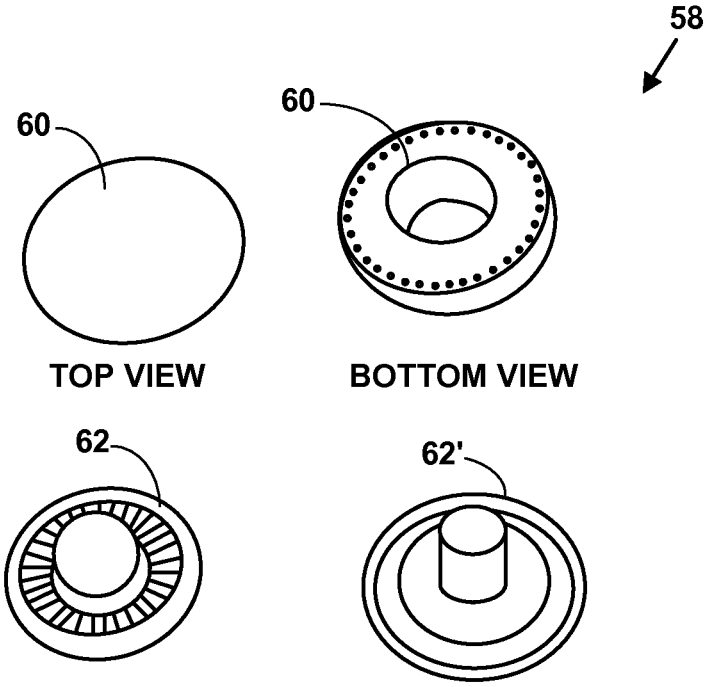
FIG. 8 is a block diagram illustrating a snap fastener.

FIG. 8 is a block diagram 58 illustrating a snap fastener 60 (top and bottom views), 62, 62'.

A snap fastener 60, 62 (also called snap, popper, press stud, etc.) is a pair of interlocking discs, made out of a metal or plastic, commonly used in place of buttons to fasten clothing and for similar purposes. A circular lip under one disc 62 fits into a groove on the top of the other disc 60, holding them fast until a certain amount of force is applied. Different types of snap fasteners 60, 62 can be attached to a fabric by riveting with a punch and die set specific to the type of rivet snaps used (e.g., striking the punch with a hammer to splay the tail, etc.), sewing, or plying with special snap pliers.

In one embodiment, the snap fastener 60, 62 includes a first snap portion 60 that is attached to the shoe cover portion 24 and a second snap portion 62 attached to the sole portion 16 of the shoe 12 and vice versa. The snap fastener components 60, 62 are included in boxes 38 in FIG. 7. FIG. 7 illustrates two snap fasteners 60, 62 on one side of the shoe 12. Two identical additional snap fasteners 60, 62 are placed on the opposite side of the shoe 12 and shoe cover portion 24. However, the present invention is not limited to two snap fasteners 66, 68, 70 and more, fewer or other snap fastener can also be used.

In another embodiment, the snap fastener 60, 62 includes a first snap portion 60 that is attached to the shoe cover portion 24 and a second snap portion 62 attached to the top portion 14 of the shoe 12, and vice versa.

In another embodiment, one individual portion 60, 62 of snap fastener 60, 62 is attached to the shoe cover portion 24 during manufacture of the shoe cover portion 24 and the other 60, 62 is manually attached to the shoe 12. In another embodiment, one individual portion 60, 62 of the snap fastener 60, 62 is attached to the shoe 12 during manufacture of the shoe 12 and the other 60, 62 is manually attached to the shoe cover portion 24. In another embodiment, one individual portion 60, 62 of the snap fastener 60, 62 is attached to the shoe cover portion 24 during manufacture of the shoe cover portion 24 and the other 60, 62 is attached to the shoe 12 during manufacture. However, the present invention is not limited to these snap attachments and other combinations of snap attachments can be used to practice the invention.

Figure 9:
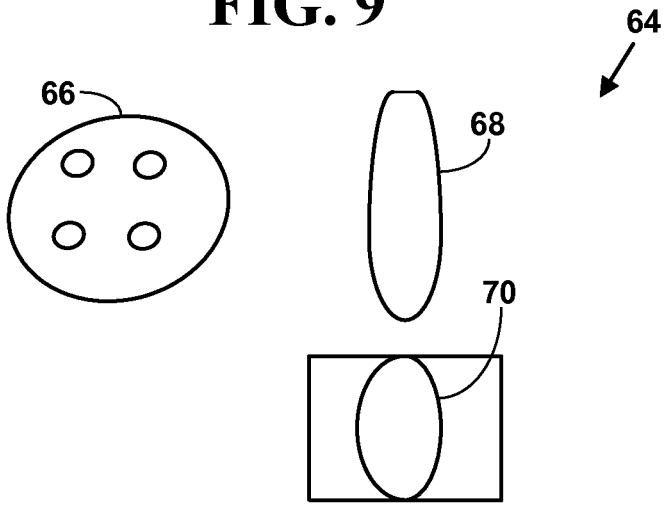
FIG. 9 is a block diagram illustrating button fastener.

FIG. 9 is a block diagram 64 illustrating a button fastener 66, 68, 70.

The button fastener components 66, 68, 70 are included in boxes 38 in FIG. 7. FIG. 7 illustrates two button fasteners 66, 68, 70 on one side of the shoe 12. Two identical additional button fasteners 66, 68, 70 are placed on the opposite side of the shoe 12 and shoe cover portion 24. However, the present invention is not limited to two button fasteners 66, 68, 70 and more, fewer or other snap fastener can also be used.

A button is a small fastener 66 most commonly made of plastic, wood or other natural or artificial material, which secures two pieces of fabric together. Buttons serving as fasteners work by slipping a button portion 66, through a fabric or thread loop 68, or by sliding through a buttonhole 70.

In one embodiment, the button fastener 66, 68, 70 includes a button portion 66 that is attached to the shoe cover portion 24 and a portion 68, 70 (e.g., loop, buttonhole, etc.) attached to the shoe 12. In another embodiment, one individual portion 66, 68, 70 of button fastener 66, 68, 70 is attached to the shoe cover portion 24 during manufacture of the shoe cover portion 24 and the other 66, 68, 70 is manually attached to the shoe 12. In another embodiment, one individual portion 66, 68, 70 the button fastener 66, 68, 70 is attached to the shoe 12 during manufacture of the shoe 12 and the other 66, 68, 70 is manually attached to the shoe cover portion 24. In another embodiment, one individual portion 66, 68, 70 of the button fastener 66, 68, 70 is attached to the shoe cover portion 24 during manufacture of the shoe cover portion 24 and the other 66, 68, 70 is attached to the shoe 12 during manufacture. However, the present invention is not limited to these button attachments and other button attachments can be used to practice the invention.

A "pin fastener" is a short cylindrical rod or tube inserted into a receptacle joining two parts so as to permit them to move in one plane relative to each other.

Figure 10:
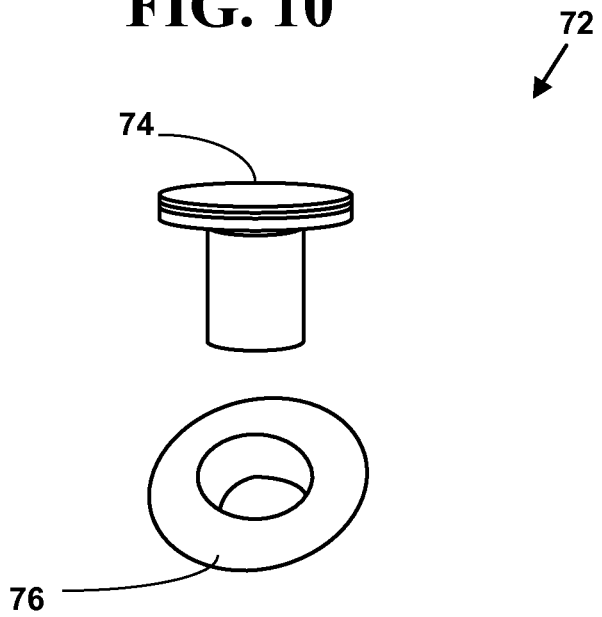
FIG. 10 is a block diagram illustrating a pin fastener.

FIG. 10 is a block diagram 72 illustrating a pin fastener 74, 76. The pin fastener includes a pin 74 and a pin receptacle 76. The pin fastener 74, 76, includes plastic, metal, wood, composite and/or materials. The pin 74 further includes a nail, screw, rivet and/or other type of fastener apparatus. The pin 74 includes smooth pins and threaded pins.

The pin fastener components 74, 76 are included in boxes 38 in FIG. 7. FIG. 7 illustrates two button fasteners 74, 76 on one side of the shoe 12. Two identical additional pin fasteners 74, 76 are placed on the opposite side of the shoe 12 and shoe cover portion 24. However, the present invention is not limited to two pin fasteners 74, 76 and more, fewer or other snap fastener can also be used.

In one embodiment, the pin fastener 74, 76 includes a pin portion 74 that is attached to the shoe cover portion 24 and a pin receptacle portion 76 attached to the shoe 12. In another embodiment, one individual portion 74, 76 of pin fastener 74, 76 is attached to the shoe cover portion 24 during manufacture of the shoe cover portion 12 and the other 74, 76 is manually attached to the shoe 12. In another embodiment, one individual portion 74, 76 of the pin fastener 74, 76 is attached to the shoe 12 during manufacture of the shoe 12 and the other 74, 76 is manually attached to the shoe cover portion 24. In another embodiment, one individual portion 74, 76 of the pin fastener 74, 76 is attached to the shoe cover portion 12 during manufacture of the shoe cover portion 24 and the other 74, 76 is attached to the shoe 12 during manufacture. However, the present invention is not limited to these button attachments and other button attachments can be used to practice the invention.

"Magnetism" is a class of physical phenomenon that includes forces exerted by magnets on other magnets. Magnetic fields are most often encountered as an invisible force created by permanent magnets which pull on ferromagnetic materials such as iron, cobalt or nickel and attract or repel other magnets.

Figure 11:
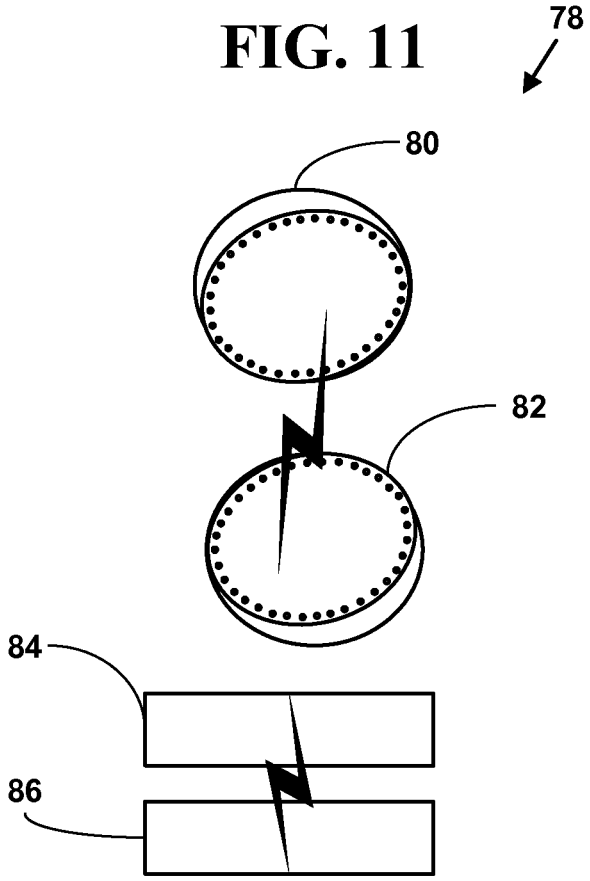
FIG. 11 is a block diagram illustrating a magnetic fastener.

FIG. 11 is a block diagram 78 illustrating a magnetic fastener 80, 82.

In one embodiment, the magnetic fastener 80, 82 includes a first magnetic portion 80, 82 that is attached to the shoe cover portion 24 and a second magnetic portion 80, 82 attached to the shoe 12. In another embodiment, one individual portion 80, 82 of magnetic fastener 80, 82 is attached to the shoe cover portion 24 during manufacture of the shoe cover portion 24 and the other 80, 82 is manually attached to the shoe 12. In another embodiment, one individual portion 80, 82 of the magnetic fastener 80, 82 is attached to the shoe 12 during manufacture of the shoe 12 and the other 80, 82 is manually attached to the shoe cover portion 12. In another embodiment, one individual portion 80, 82 of the magnetic fastener 80, 82 is attached to the shoe cover portion 12 during manufacture of the shoe cover portion 24 and the other 80, 82 is attached to the shoe 12 during manufacture. However, the present invention is not limited to these button attachments and other button attachments can be used to practice the invention.

In one embodiment, the magnetic fastener 80, 82 includes a flexible magnetic tape 84, 86. However, the present invention is not limited to these embodiments and other embodiments can also be used to practice the invention.

Figure 12:
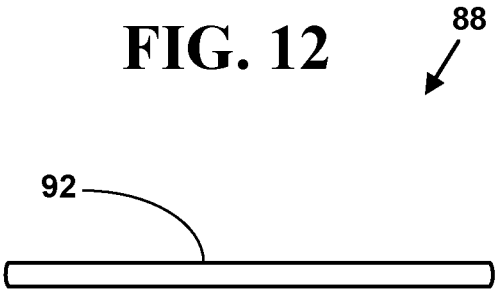
FIG. 12 is a block diagram illustrating a strap fastener.

FIG. 12 is a block diagram 88 illustrating a strap fastener 92. FIG. 2 item 38 illustrates a strap fastener 92 that wraps through pre-existing features 42, 42' (FIG. 3) of the sole portion 16 of the shoe 12. The pre-existing features 42, 42' are exemplary only and the present invention is not limited to a size, shape, etc. of the illustrated pre-existing features on the sole portion 16 of the shoe 12. Such pre-existing features 42, 42' vary depending on the type of shoe 12 used.

In one embodiment, the strap fastener 92 includes synthetic fiber fabrics, natural fiber fabrics, composite materials fabrics, hard plastics, soft plastics and combinations thereof as was described above for the shoe cover portion 24. In one embodiment the strap fastener 92 includes an elastic material. However, the present invention is not limited to these strap fasteners and more, fewer and/or other shoe cover portions can be used to practice the invention.

The strap fastener 92 further includes, but is not limited to, hook and loop fasteners 50, 52, snap fasteners 60, 62, button fasteners, 66, 68, 70, pin fasteners 74, 76, magnetic fasteners 80, 82, 84, 86 and/or other types of fasteners at one or both ends of the strap fastener 92. However, the present invention is not limited to these strap end fasteners and more, fewer, none and/or other strap end fasteners can be used to practice the invention.

Figure 13:
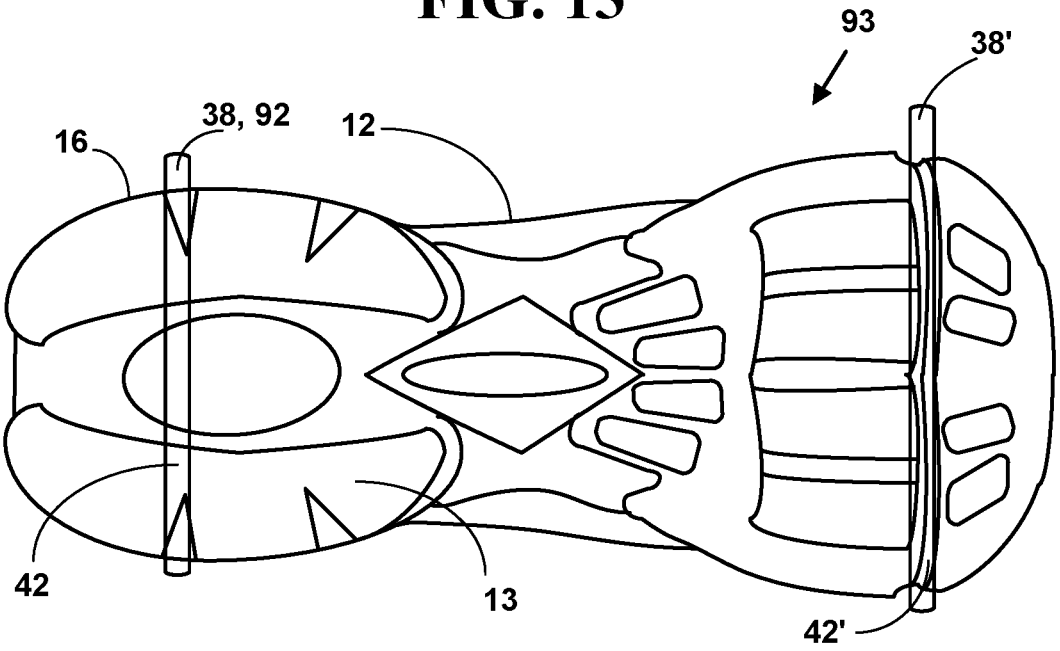
FIG. 13 is a block diagram illustrating an exemplary sole portion of the exemplary athletic shoe of FIG. 2.

FIG. 13 is a block diagram 93 an exemplary sole portion 16 of the exemplary athletic shoe 12 of FIG. 2.

Selected ones of the plural second attachments portions 38, 38' are specifically sized and shaped to attach onto and through pre-existing features 42, 42' (e.g., grooves, sole patterns, etc.) (FIG. 13) of the sole portion 16 of the shoe 12. For example, shoe-X 12 includes a first groove 42' ten millimeters from the front of the shoe 12 and a second grove 42 twenty millimeters from the back of the shoe 12. Selected ones of the plural second attachments portions 38, 38' (e.g., strap fastener 92, etc.) are specifically sized and shaped to attach onto and through pre-existing features 42, 42' with the exemplary measurements described. Shoe-Y 12 includes a first groove 42' thirty millimeters from the front of the shoe 12 and a second grove 42 twenty-five millimeters from the back of the shoe 12. Selected ones of the plural second attachments portions 38, 38' (e.g., strap fastener 92, etc.) are specifically sized and shaped to attach onto and through pre-existing features 42, 42' with the exemplary measurements described. However, the present invention is not limited to these measurements and pre-existing features on the sole 16 of the shoe 12 and more, fewer, none and/or other types of selected ones of the plural second attachments portions 38, 38' can be used to practice the invention.

In one embodiment, plural different shoe cover portions 24 with plural different types of selected ones of the plural second attachments portions 38, 38' are created for shoe-X, shoe-Y, shoe-Z 12, etc. which have different sole portion 16 patterns and/or and pre-existing features.

In another embodiment, shoe cover portion 24 includes adjustable, attachable and removable selected ones of the plural second attachments portions 38, 38' that are positioned and re-positioned for different types of shoes shoe-X, shoe-Y, shoe-Z 12, etc. which have different sole portion 16 patterns and/or and pre-existing features. Such and embodiment provides a more flexible design.

In one embodiment, the shoe cover connection portion 30 includes synthetic fiber fabrics, natural fiber fabrics, composite materials fabrics, hard plastics, soft plastics and combinations thereof as was described above for the shoe cover portion 22. However, the present invention is not limited to these shoe cover connection portion 30 and more fewer and/or other shoe cover portions can be used to practice the invention.

In one embodiment, the shoe cover connection portion 30 is coated with an insect repellent after selecting a desired fabric for the shoe cover connection. The insect repellent fabric repels mosquitoes, ticks, ants, flies, chiggers, midges (i.e., no-see-ums, etc.) and other insects. Such an embodiment protects a user 34 of the apparatus 20 from being bitten when running, hiking, etc. in areas with such biting insects.

In one embodiment, the insect repellent coating compound includes: (1) DEET (chemical name, N,N-diethyl-meta-toluamide). DEET is the active ingredient in many insect repellent products. It is used to repel biting pests such as mosquitoes and ticks, including ticks that may carry Lyme disease; (2) PICARIDIN (also known as KBR 3023, Bayrepel, and icaridin) PICARIDIN products include CUTTER ADVANCED, SKIN SO SOFT BUG GUARD PLUS, AND AUTAN [outside the US]); (3) Oil of lemon eucalyptus (OLE) or PMD. Products containing OLE include REPEL and OFF! Botanicals); or (4) IR3535. Products containing IR3535 include SKIN SO SOFT BUG GUARD PLUS EXPEDITION and SKINSMART). However, the present invention is not limited to such insect repellants and more fewer of other types of insect repellants can be used to practice the invention.

In another embodiment, the shoe cover connection portion 30 comprises an insect repellant fabric with an integral insect repellant fabric including a permethrin coating, or other insect repellant coating, which is coated during a manufacturing process of the insect repellant fabric. "Permethrin" is a common synthetic chemical, widely used as an insecticide, acaricide, and insect repellent. It belongs to the family of synthetic chemicals called pyrethroids and functions as a neurotoxin, affecting neuron membranes by prolonging sodium channel activation. In general, it has a low mammalian toxicity and is poorly absorbed by skin. In one embodiment, the permethrin coating is chemically bound tightly to fabric fibers during manufacture of a fabric resulting in effective, odorless insect protection that lasts for the lifetime of the fabric it is attached to. Such permethrin coated fabrics have been approved in the United States by the Environmental Protection Agency (EPA).

In one embodiment, the shoe cover connection portion 30 is also includes a waterproof and/or water resistant breathable fabrics and/or fabrics coated with a waterproof coating in addition to the insect repellant fabric. In another embodiment, the shoe cover connection portion 30 includes only a waterproof and/or water resistant breathable fabrics and/or fabrics coated with a waterproof and/or water resistant coating and the insect repellant fabric is not used. In another embodiment, selected portions of the shoe cover connection portion 30 are coated with and/or include waterproof and/or water resistant fabric and selected other portions include insect proof fabric. However, the present invention is not limited to these embodiments and various combinations of coated waterproof, coated insect proof and/or insect repellant fabrics and/or water resistant and or/waterproof fabrics can be used to practice the invention. However, the present invention is not limited to these embodiments and various combinations of coated waterproof, coated insect proof and/or insect repellant fabrics and/or water resistant and or/waterproof fabrics can be used to practice the invention.

Figure 14:
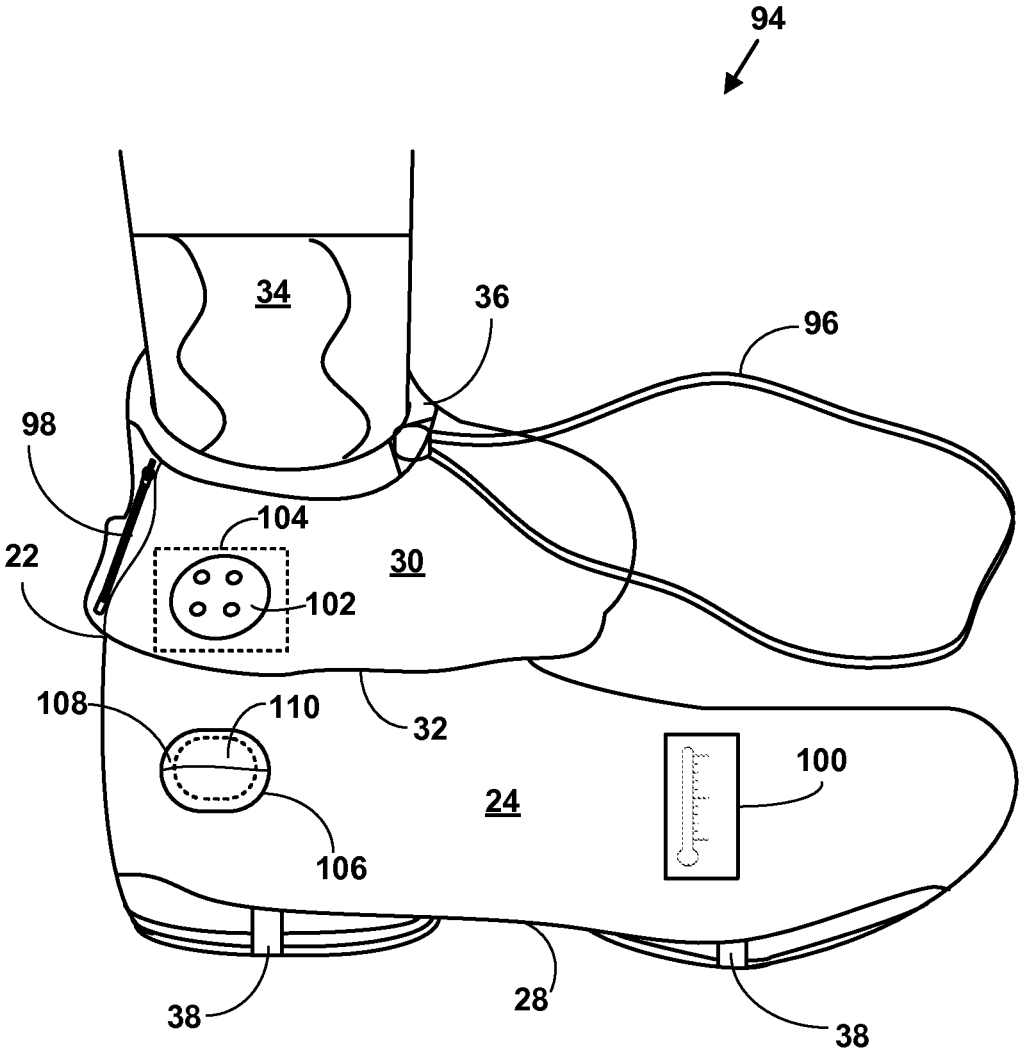
FIG. 14 is a block diagram of a portable shoe cover apparatus for the exemplary athletic shoe of FIG. 1.

FIG. 14 is a block diagram 94 of a portable shoe cover apparatus for the exemplary athletic shoe of FIG. 1.

In one embodiment, the shoe cover connection portion 30 includes a shoe cover attachment portion 36, includes an elastic fastener 46, a zipper fastener 98, a cinched loop fastener 96, a hoop and loop fastener 50, 52 and/or other types of fasteners for attaching the shoe covering apparatus 20 to a person 34 wearing the shoe 12.

FIG. 14 illustrates various types of fasteners on the shoe cover portion 24 and shoe cover connection portion 30. However, the present invention is not limited to the combinations illustrated and more, fewer and other types of fasteners and/or other combinations thereof, may be used to practice the invention.

For example, the shoe cover connection portion 30 may only include zipper fastener 98 and not cinched loop fastener 96, only include cinched loop fastener 96 and not zipper fastener 98, etc. The same applies for combinations thereof of fasteners for the shoe cover portion 24.

In one embodiment, the shoe cover portion 24 and the shoe cover connection portion 30 include a same fabric. In another embodiment, the shoe cover portion 24 and the shoe cover connection portion 30 include a different fabric. In another embodiment, the shoe cover portion 24 and the shoe cover connection portion 30 include combinations of a same and/or different fabrics. In another embodiment, the shoe cover portion 24 and the shoe cover connection portion 30 include combinations of a same and/or different fabrics including, but not limited to, waterproof and/or insect repellant fabrics. However, the present invention is not limited to these fabrics and more fewer and/or other types of fabrics can be used to practice the invention.

In one embodiment, the shoe cover portion 24 and/or shoe cover connection portion 30 further includes a liquid crystal (LCD) thermometer 100 or plastic strip thermometer integral to the shoe cover connection portion 24 and/or the shoe cover connection portion. Such thermometers are a type of thermometer that contains heat-sensitive (i.e., thermochromic) liquid crystals in a plastic strip that change color to indicate different temperatures. Liquid crystals possess the mechanical properties of a liquid, but have the optical properties of a single crystal. Temperature changes affect the color of a liquid crystal, which makes them useful for temperature measurement.

Such thermometers 100 are useful for determining a temperature when the apparatus 20 is being used in inclement weather and/or used to determine when to open and/or close a venting portion 102. However, the present invention is not limited to such thermometers and other sensors and/or temperature measuring devices can be used to practice the invention.

In one embodiment, the shoe cover connection portion 30 further includes a vent portion 102 integral to the shoe cover connection portion 30 for venting heat and moisture from the person 34 wearing the shoe 12. In one embodiment, the venting portion 102 includes a portion with plural holes and a moveable flap to cover and uncover the portion with plural holes. In such an embodiment, the vent portion 102 is used to vent heat and/or moisture from a person wearing the shoe 12 to increase comfort of the person 34 wearing the shoe 12. In one embodiment, the vent 102 includes a flap 104 that is used to open and/or close the vent 102. However, the present invention is not limited to such vents and more, fewer, other and/or no vents can be used to practice the invention.

In one embodiment, the shoe cover portion 24 further includes a pocket portion 106 in the shoe cover portion 24 or shoe cover connection portion 30 for inserting a pedometer (e.g., FITBIT, etc.) and/or electronic fitness tracking chip and/or fitness tracking sensor (e.g. NIKE+ sensor, etc.). In such an embodiment, the pocket portion 106 includes a flap 108 that is used to open and/or close the pocket 106. The pocket portion 106 may also be used to hold other small items such as a key, etc.

In another embodiment, the shoe cover portion 24 and/or the shoe cover connection portion 30 include an integral pedometer and/or electronic fitness tracking chip and/or fitness tracking sensor 110 (only illustrated in the shoe cover connection portion 30 for simplicity in FIG. 14) placed within the pocket portion 106. In such an embodiment, the pedometer and/or fitness chip and/or fitness sensor 110 is included in another integral pocket portion 106' without a flap 108. In such an embodiment, the integral pedometer and/or electronic fitness tracking chip and/or fitness tracking sensor 110 is not removable. In another embodiment, the integral pedometer and/or electronic fitness tracking chip and/or fitness tracking sensor 110 is removable (e.g., via an opening, etc. in the shoe cover portion 24 and/or the shoe cover connection portion 30). However, the present invention is not limited to such pocket portions and more, fewer, other and/or no pocket portions can be used to practice the invention.

Figure 15:
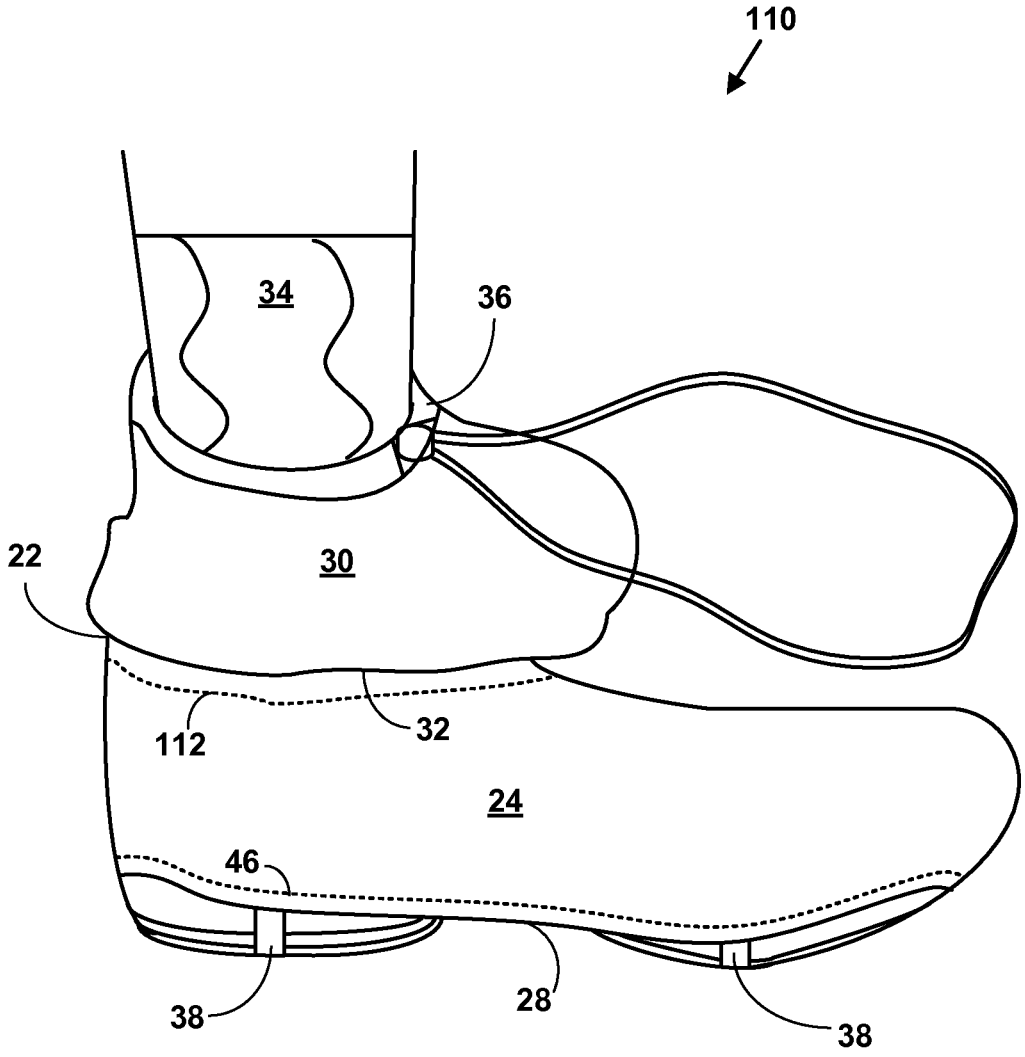
FIG. 15 is a block diagram of a portable shoe cover apparatus for the exemplary athletic shoe of FIG. 1 including a waterproof gasket.

FIG. 15 is a block diagram 110 of a portable shoe cover apparatus 22 for the exemplary athletic shoe 12 of FIG. 1 including a waterproof gasket 112.

In such an embodiment, the waterproof gasket 112 is integral to the portable shoe cover apparatus 22 and is included at an interface between the shoe cover portion 24 and the shoe cover connection portion 30. The waterproof gasket 112 keeps water and/or other moisture out of the shoe cover portion 24 and therefore away from the person 34 wearing the shoe 12. In such an embodiment, the waterproof gasket 112 is made integral during the manufacturing process is not replaceable, attachable or removable. However, the present invention is not limited to such an embodiment and other embodiments may be used to practice the invention.

A "waterproof gasket" 112 is a mechanical seal which fills s space between two or more mating surfaces (e.g., shoe cover portion 24 and shoe cover connection portion 30, etc.), generally to prevent leakage of water and/or moisture between the two surfaces. Gaskets are normally made from a flat material, a sheet such as paper, rubber, composite materials, silicone, metal, cork, felt, neoprene, nitrile rubber, fiberglass, polytetrafluoroethylene (otherwise known as PTFE or TEFLON, etc.) and/or a plastic polymer (e.g., polychlorotrifluoroethylene, etc.) and/or combinations thereof.

However, the present invention is not limited to the waterproof gaskets 112 described and more, fewer and/or other types of waterproof gaskets can be used to practice the invention. In addition, the present invention can be practice with and/or without the waterproof gasket 112.

In another embodiment the waterproof gasket 112 is replaceable, and is therefore attachable and/or removable. However, the present invention is not limited to such an embodiment and other embodiments may be used to practice the invention.

The portable shoe cover apparatus 20 described herein provides, but is not limited to, at least the following advantages: (1) protects a top of a of an athletic and/or other shoe they cover from water, snow, mud, etc. (2) protects an ankle or leg of a wearer from moisture and biting insects; (3) attaches easily to virtually any existing shoe with a plural different types of fasteners; (4) attaches to pre-existing features of a top and/or sole of the shoes they cover; (5) provides insulation in severe cold weather; and (6) provides protection against biting insects such as ticks that can cause serious diseases such as Lyme disease.

It should be understood that the programs, processes, methods and system described herein are not related or limited to any particular type of computer or network system (hardware or software), unless indicated otherwise. Various types of general purpose or specialized computer systems may be used with or perform operations in accordance with the teachings described herein.

In view of the wide variety of embodiments to which the principles of the present invention can be applied, it should be understood that the illustrated embodiments materials and features are exemplary only, and should not be taken as limiting the scope of the present invention. For example, the steps of the block diagrams include more, fewer or other types of elements.

While various elements of the preferred embodiments have been described as being implemented in specific materials, in other embodiments other materials may alternatively be used, and vice-versa.

The claims should not be read as limited to the described order or elements unless stated to that effect. In addition, use of the term "means" in any claim is intended to invoke 35 U.S.C. § 112, paragraph 6, and any claim without the word "means" is not so intended.

Therefore, all embodiments that come within the scope and spirit of the following claims and equivalents thereto are claimed as the invention.

I claim:

1. A portable shoe covering apparatus, comprising in combination:

a shoe including a plurality of pre-existing sole features comprising a plurality of receptacles extending through a bottom surface of a sole of the shoe at pre-determined locations;

a shoe cover portion of the portable shoe covering apparatus attachable and removable for covering a top portion of the shoe but not covering a bottom surface of the sole of the shoe comprising a waterproof portion or water resistant portion;

a Liquid Crystal Display (LCD) flexible strip thermometer integral to a top surface of the shoe cover portion and visible from the top surface of the shoe cover portion determining a temperature around the portable shoe covering apparatus;

a fitness tracking sensor integral to the shoe cover portion;

a shoe cover connection portion connected to a top end of the shoe cover portion, comprising an insect repellant portion;

a plurality of first attachment portions attached at a bottom end of the shoe cover portion for attaching the shoe cover portion to the top portion of the shoe, wherein selected ones of the plurality of first attachment portions are specifically sized and shaped to attach onto pre-existing features of the top portion of the shoe; and a plurality of second strap attachment portions attached to the bottom end of the shoe cover portion for attaching the shoe cover portion through pre-existing sole features of the sole of the shoe, comprising:

a first fixed individual second strap attachment portion from the plurality of second strap attachment portions specifically sized, shaped, aligned and attached at a fixed pre-determined location on the bottom end of the shoe cover to attach the shoe cover portion through a first pre-existing sole feature including a first receptacle of a forefoot portion of the sole of the shoe with a first end attached to a first point on a first side of the bottom end of the shoe cover portion in alignment with the first end of the first pre-existing sole feature of the forefoot portion including the first receptacle in the forefoot portion of the sole of the shoe and a second end of the first fixed individual second attachment portion attached to a second point on a second side on the bottom portion of the shoe cover portion, in alignment with a second end of the first receptacle in the forefoot portion of the sole of the shoe, thereby allowing the first fixed individual second attachment portion fit to within the first receptacle in the first pre-existing sole feature in the forefoot portion of the sole of the shoe to attach the shoe cover portion to the shoe at the first point and the second point through the forefoot portion of the sole of the shoe the first fixed individual second strap attachment portion and not extending over or covering any other portion of the bottom surface of the sole of the shoe; and one or more other non-fixed second ones of the plurality of second strap attachment portions attachable, removable and adjustable for positioning at one or more other different points on the bottom end of the shoe cover portion to additionally attach the shoe cover portion to the shoe at the one or more other points through other sole features including other receptacles in a midsole portion or a heel portion the sole of the shoe the one or more other non-fixed second ones of the plurality of second strap attachment portions and not extending over or covering any other portion of the bottom surface of the sole of the shoe.

2. The shoe covering apparatus of claim 1 wherein the shoe cover portion includes a fabric comprising: a synthetic fiber fabric, natural fiber fabric, composite materials fabric, hard plastics, soft plastics or combinations thereof.

3. The shoe covering apparatus of claim 2 wherein the shoe cover portion comprises the fabric coated with a waterproof compound or a water resistant compound or comprises a waterproof fabric or a water resistant fabric with an integral waterproof or water resistant compound added during manufacture of the fabric to prevent water from attaching to the shoe cover portion.

4. The shoe covering apparatus of claim 1 wherein the plurality of first attachment portions include a zipper fastener, an elastic fastener, a hook and loop fastener, a snap fastener, a button fastener, a magnetic fastener, a pin fastener, a strap fastener or combinations thereof.

5. The shoe covering apparatus of claim 4 wherein a first portion of the hook and loop fastener portion is attached to the shoe cover portion and a second portion of the hook and loop fastener portion is attached to the shoe.

6. The shoe covering apparatus of claim 4 wherein a first portion of the snap fastener portion is attached to the shoe cover portion and a second portion of the snap fastener portion is attached to the shoe.

7. The shoe covering apparatus of claim 4 wherein a first portion of the button fastener is attached to the shoe cover portion and a second portion of the button fastener portion is attached to the shoe.

8. The shoe covering apparatus of claim 4 wherein a first portion of the pin fastener includes a pin and a first pin receptacle on the shoe cover portion and a second portion of the pin fastener portion includes a second pin receptacle in the shoe for accepting the pin placed through the first pin receptacle on the shoe cover portion and into the second pin receptacle in the shoe.

9. The shoe covering apparatus of claim 1 wherein the selected ones of the first attachment portions specifically sized and shaped to attach onto pre-existing features of the top portion of the shoe include selected ones of the first attachment portions specifically sized and shaped to attach to laces of the top portion of the shoe, straps attached to the top portion shoe, or ridges, grooves, receptacles or other structure features on the top portion of the shoe.

10. The shoe covering apparatus of claim 1 wherein the shoe cover connection portion includes a fabric comprising: a synthetic fiber fabric, natural fiber fabric, composite materials fabric, hard plastic, soft plastic and combinations thereof.

11. The shoe covering apparatus of claim 10 wherein the shoe cover connection portion comprises the fabric coated with an insect repellant compound or comprises the fabric with an integral insect repellant compound added during manufacture of the fabric to prevent insects from attaching to the shoe cover connection portion.

12. The shoe covering apparatus of claim 1 wherein the shoe cover connection portion includes an elastic fastener, a zipper fastener, a laced fastener, a cinched loop fastener, a strap fastener, a hoop and loop fastener or combinations thereof for attaching the shoe covering apparatus.

13. The shoe covering apparatus of claim 1 wherein selected ones of the plurality of second strap attachment portions are specifically sized and shaped to attach through or into pre-existing features of the sole of the shoe further include straps or bands attached through grooves, receptacles or other structural features on a bottom sole portion of the shoe.

14. The shoe covering apparatus of claim 13 wherein the selected ones of the plurality of the second strap attachment portions are specifically sized and shaped to attach onto pre-existing features of the sole of the shoe including a hook and loop fastener, a snap fastener, a button fastener or a pin fastener attached to the sole portion of the shoe.

15. The shoe covering apparatus of claim 14 wherein a first portion of the hook and loop fastener is attached to a portion of a selected one of the second strap attachment portions and a second portion of the hook and loop fastener portion is attached to a side portion or top portion of the sole portion of the shoe.

16. The shoe covering apparatus of claim 12 wherein a first portion of the snap fastener is attached to a portion of the selected one of the second strap attachment portion and a second portion of the snap fastener portion is attached to a side portion or a top portion of the sole portion of the shoe or wherein a first portion of the button fastener is attached to a portion of the selected one of the second strap attachment portions and a second portion of the button fastener portion is attached to a side portion or a top portion of the sole portion of the shoe or wherein a first portion of the pin fastener includes a pin and a first pin receptacle on the shoe cover portion and a second portion of the pin fastener portion includes a second pin receptacle in a side portion or a top portion of the sole portion of the shoe for accepting the pin placed through the first pin receptacle on the shoe cover portion and into the second pin receptacle.

17. The shoe covering apparatus of claim 1 wherein the shoe cover portion further includes an insect repellant fabric portion and the shoe cover connection portion further includes a waterproof fabric or a water resistant fabric portion.

18. The shoe covering apparatus of claim 1 further comprising a vent portion integral to the shoe cover connection portion for venting heat and moisture.

19. The shoe covering apparatus of claim 1 further comprising a Liquid Crystal Display (LCD) flexible strip thermometer integral to the shoe cover connection portion.

20. A portable shoe covering apparatus, comprising in combination:

a shoe including a plurality of pre-existing sole features comprising a plurality of receptacles extending through a bottom surface of a sole of the shoe at pre-determined locations;

a shoe cover portion of the portable shoe covering apparatus attachable and removable for covering a top portion of the shoe but not covering a bottom surface of the sole of the shoe comprising a waterproof portion or water resistant portion;

a shoe cover connection portion connected to a top end of the shoe cover portion, comprising an insect repellant portion;

a waterproof gasket comprising an interface connecting the shoe cover portion and the shoe cover connection portion comprising a moisture repellant portion;

a vent portion integral to the shoe cover connection portion for venting heat and moisture from the shoe cover connection portion;

a Liquid Crystal Display (LCD) flexible strip thermometer integral to a top surface of the shoe cover portion and visible from the top surface of the shoe cover portion determining a temperature around the portable shoe covering apparatus;

a pedometer or a fitness tracking chip or a fitness tracking sensor;

a pocket portion in the shoe cover portion or the shoe cover connection portion for inserting and removing the pedometer or the fitness tracking chip or the fitness tracking sensor;

a plurality of first attachment portions attached at a bottom end of the shoe cover portion for attaching the shoe cover portion to the top portion of the shoe, wherein selected ones of the plurality of first attachment portions are specifically sized and shaped to attach onto pre-existing features of the top portion of the shoe; and a plurality of second strap attachment portions attached to the bottom end of the shoe cover portion for attaching the shoe cover portion through pre-existing sole features of the sole of the shoe, comprising:

a first fixed individual second strap attachment portion from the plurality of second strap attachment portions specifically sized, shaped, aligned and attached at a fixed pre-determined location on the bottom end of the shoe cover to attach the shoe cover portion through a first pre-existing sole feature including a first receptacle of a forefoot portion of the sole of the shoe with a first end attached to a first point on a first side of the bottom end of the shoe cover portion in alignment with the first end of the first pre-existing sole feature of the forefoot portion including the first receptacle in the forefoot portion of the sole of the shoe and a second end of the first fixed individual second attachment portion attached to a second point on a second side on the bottom portion of the shoe cover portion, in alignment with a second end of the first receptacle in the forefoot portion of the sole of the shoe, thereby allowing the first fixed individual second attachment portion fit to within the first receptacle in the first pre-existing sole feature in the forefoot portion of the sole of the shoe to attach the shoe cover portion to the shoe at the first point and the second point through the forefoot portion of the sole of the shoe the first fixed individual second strap attachment portion and not extending over or covering any other portion of the bottom surface of the sole of the shoe; and one or more other non-fixed second ones of the plurality of second strap attachment portions attachable, removable and adjustable for positioning at one or more other different points on the bottom end of the shoe cover portion to additionally attach the shoe cover portion to the shoe at the one or more other points through other sole features including other receptacles in a midsole portion or a heel portion the sole of the shoe the one or more other non-fixed second ones of the plurality of second strap attachment portions and not extending over or covering any other portion of the bottom surface of the sole of the shoe.

* * * * *